US008027610B2

(12) United States Patent
Yamazaki

(10) Patent No.: US 8,027,610 B2
(45) Date of Patent: Sep. 27, 2011

(54) IMAGE FORMING APPARATUS AND CONTROL METHOD FOR PRINTING WITHOUT A MARGIN

(75) Inventor: Fumiya Yamazaki, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 565 days.

(21) Appl. No.: 11/677,675

(22) Filed: Feb. 22, 2007

(65) Prior Publication Data

US 2007/0201893 A1 Aug. 30, 2007

(30) Foreign Application Priority Data

Feb. 27, 2006 (JP) ..... 2006-051168
Feb. 14, 2007 (JP) ..... 2007-034040

(51) Int. Cl.
*G03G 15/00* (2006.01)

(52) U.S. Cl. ..... 399/82; 399/13; 399/45; 399/389

(58) Field of Classification Search ..... 399/45, 399/81, 82, 197, 388, 389, 391, 190, 13, 399/66, 101, 51, 308, 309
See application file for complete search history.

(56) References Cited

U.S. PATENT DOCUMENTS 4,875,063 A * 10/1989 Idenawa et al.
5,523,822 A * 6/1996 Tsuda ..... 399/13
5,831,947 A * 11/1998 Okazaki et al.
6,799,011 B2 * 9/2004 Abe et al. ..... 399/299
6,895,195 B2 * 5/2005 Katamoto ..... 399/45
6,957,885 B2 * 10/2005 Noguchi et al. ..... 347/101
7,308,227 B2 * 12/2007 Ahn ..... 399/388
2001/0021027 A1 * 9/2001 Ueno et al.
2004/0037581 A1 * 2/2004 Maeda ..... 399/82
2004/0190927 A1 * 9/2004 Tsukamoto et al. ..... 399/82
2006/0216047 A1 * 9/2006 Yamamoto et al. ..... 399/45
2007/0025780 A1 * 2/2007 Kurosu et al.

FOREIGN PATENT DOCUMENTS

JP 03132673 A * 6/1991
JP 2004-045457 2/2004
JP 2006321593 A * 11/2006
WO WO 2004099883 A1 * 11/2004

OTHER PUBLICATIONS

English Translation of JP 2004-045457 A.*

* cited by examiner

*Primary Examiner* — David Porta
*Assistant Examiner* — Milton Gonzalez
(74) *Attorney, Agent, or Firm* — Fitzpatrick, Cella, Harper & Scinto

(57) ABSTRACT

An image forming apparatus according to this invention which allows double-sided printing can reduce the toner consumption amount by decreasing the size of a developer image on the second page as compared with the size of a developer image printed on the first page in margin-less printing. To accomplish this, the image forming apparatus includes a setting unit adapted to set, when images are to be formed on both surfaces of a printing material without margin, a size of a developer image on a second page of the printing material smaller than a size of a developer image on a first page of the printing material.

10 Claims, 19 Drawing Sheets

FIG. 9

| PAPER FEED PORT | DIMENSION OF PRINTING MATERIAL IN SUB SCANNING DIRECTION | DIMENSION OF PRINTING MATERIAL IN MAIN SCANNING DIRECTION |
|---|---|---|
| TRAY 1 | UNKNOWN | UNKNOWN |
| CASSETTE 1 | 211 mm | 298 mm |
| CASSETTE 2 | 215 mm | UNKNOWN |
| ... | ... | ... |

FIG. 12

| PAPER FEED PORT | BEFORE IMAGE FORMATION ON FIRST PAGE | | AFTER IMAGE FORMATION ON FIRST PAGE | |
|---|---|---|---|---|
| | DIMENSION OF PRINTING MATERIAL IN SUB SCANNING DIRECTION | DIMENSION OF PRINTING MATERIAL IN MAIN SCANNING DIRECTION | DIMENSION OF PRINTING MATERIAL IN SUB SCANNING DIRECTION | DIMENSION OF PRINTING MATERIAL IN MAIN SCANNING DIRECTION |
| TRAY 1 | UNKNOWN | UNKNOWN | UNKNOWN | UNKNOWN |
| CASSETTE 1 | 211 mm | 298 mm | 210 mm | 298 mm |
| CASSETTE 2 | 215 mm | UNKNOWN | UNKNOWN | UNKNOWN |
| ... | ... | ... | ... | ... |

FIG. 15

| PAPER FEED PORT | BEFORE IMAGE FORMATION ON FIRST PAGE | | AFTER IMAGE FORMATION ON SECOND PAGE | |
|---|---|---|---|---|
| | DIMENSION OF PRINTING MATERIAL IN SUB SCANNING DIRECTION | DIMENSION OF PRINTING MATERIAL IN MAIN SCANNING DIRECTION | DIMENSION OF PRINTING MATERIAL IN SUB SCANNING DIRECTION | DIMENSION OF PRINTING MATERIAL IN MAIN SCANNING DIRECTION |
| TRAY 1 | UNKNOWN | UNKNOWN | UNKNOWN | UNKNOWN |
| CASSETTE 1 | 211 mm | 298 mm | 210 mm | 298 mm |
| CASSETTE 2 | 215 mm | UNKNOWN | UNKNOWN | UNKNOWN |
| ... | ... | ... | ... | ... |

IMAGE FORMING APPARATUS AND CONTROL METHOD FOR PRINTING WITHOUT A MARGIN

BACKGROUND OF THE INVENTION

1. Field of the Invention

The present invention relates to an image forming apparatus which allows margin-less printing for printing on a printing material without margin and, more particularly, to an image forming apparatus which allows double-sided printing without margin.

2. Description of the Related Art

Recent inkjet and bubble-jet® printers can form an image on the entire surface of a printing material. This scheme is called margin-less printing because no margin is formed at the peripheral portion of a printing material. There is also proposed an approach to such margin-less printing, in which an electrophotographic image forming apparatus forms a developer image to be larger than a printing material and transfers it onto the printing material.

Japanese Patent Laid-Open No. 2004-45457 discloses an electrophotographic image forming apparatus which attains margin-less printing by forming a developer image to be larger than a printing material. The technique described in Japanese Patent Laid-Open No. 2004-45457 forms a developer image sufficiently larger than a printing material, so the printing material has no margin even when the developer image is slightly misaligned with respect to the printing material.

However, since the image forming apparatus described in Japanese Patent Laid-Open No. 2004-45457 forms a developer image sufficiently larger than a printing material, it wastes a portion of the developer (toner) which is not transferred onto the printing material. Especially, for example, when the size of a printing material to be conveyed is unknown before the start of printing, a conventional image forming apparatus forms a developer image to match the maximum size of a printable printing material in printing. Therefore, when the conventional image forming apparatus prints a printing material whose size is unknown but is actually small, it produces a large amount of toner which is not transferred onto the printing material. That is, when the conventional image forming apparatus performs margin-less printing for a printing material whose size is unknown, it consumes toner in very large quantities.

An electrophotographic image forming apparatus, in particular, generates a double-sided printed printing material having dimensions in the main scanning direction and sub scanning direction which have slightly shortened upon fixing processing in printing on the first page. The dimensions of the printing material decrease because the printing material shrinks due to heat in the fixing processing. This makes an image forming region of the printing material in printing on the second page narrower than that on the first page. However, the conventional image forming apparatus forms developer images on the first and second pages with the same size in margin-less printing. A larger amount of waste toner is cleaned and recovered without being transferred onto the printing material in margin-less printing on the second page than in printing on the first page. A portion of the developer (the developer image which is not transferred onto the printing material) formed outside the printing material mainly accounts for the toner wasted in margin-less printing.

SUMMARY OF THE INVENTION

The present invention enables to provide an image forming apparatus which allows double-sided printing without margin while reducing the toner consumption amount, i.e., while reducing the toner consumption amount by decreasing the size of a developer image in printing on the second page as compared with that of a developer image on the first page. It is another object of the present invention to reduce the toner consumption amount by decreasing the size of a developer image in printing even on the first page.

According to an aspect of the present invention, an image forming apparatus comprising: an image forming unit adapted to form a developer image to be larger than a printing material when the image is to be formed on the printing material without margin; an intermediate transfer member adapted to carry the image formed by the image forming unit; a transferring unit adapted to transfer the developer image formed on the intermediate transfer member onto the printing material; a fixing unit adapted to fix the developer image transferred by the transferring unit to the printing material; a double-sided conveying unit adapted to turn over the printing material output from the fixing unit and convey the printing material to the transferring unit again; a cleaning unit adapted to remove the developer remaining on the intermediate transfer member after transferring the developer image onto the printing material; and a setting unit adapted to set, when images are to be formed on both surfaces of a printing material without margin, a size of a developer image on a second page of the printing material smaller than a size of a developer image on a first page of the printing material.

Further features of the present invention will become apparent from the following description of exemplary embodiments with reference to the attached drawings.

BRIEF DESCRIPTION OF THE DRAWINGS

FIG. 9 is a table showing information stored in a memory in the first embodiment;

FIG. 12 is a table showing information stored in a memory in the second embodiment;

FIG. 15 is a table showing information stored in a memory in the third embodiment.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Figure 1:
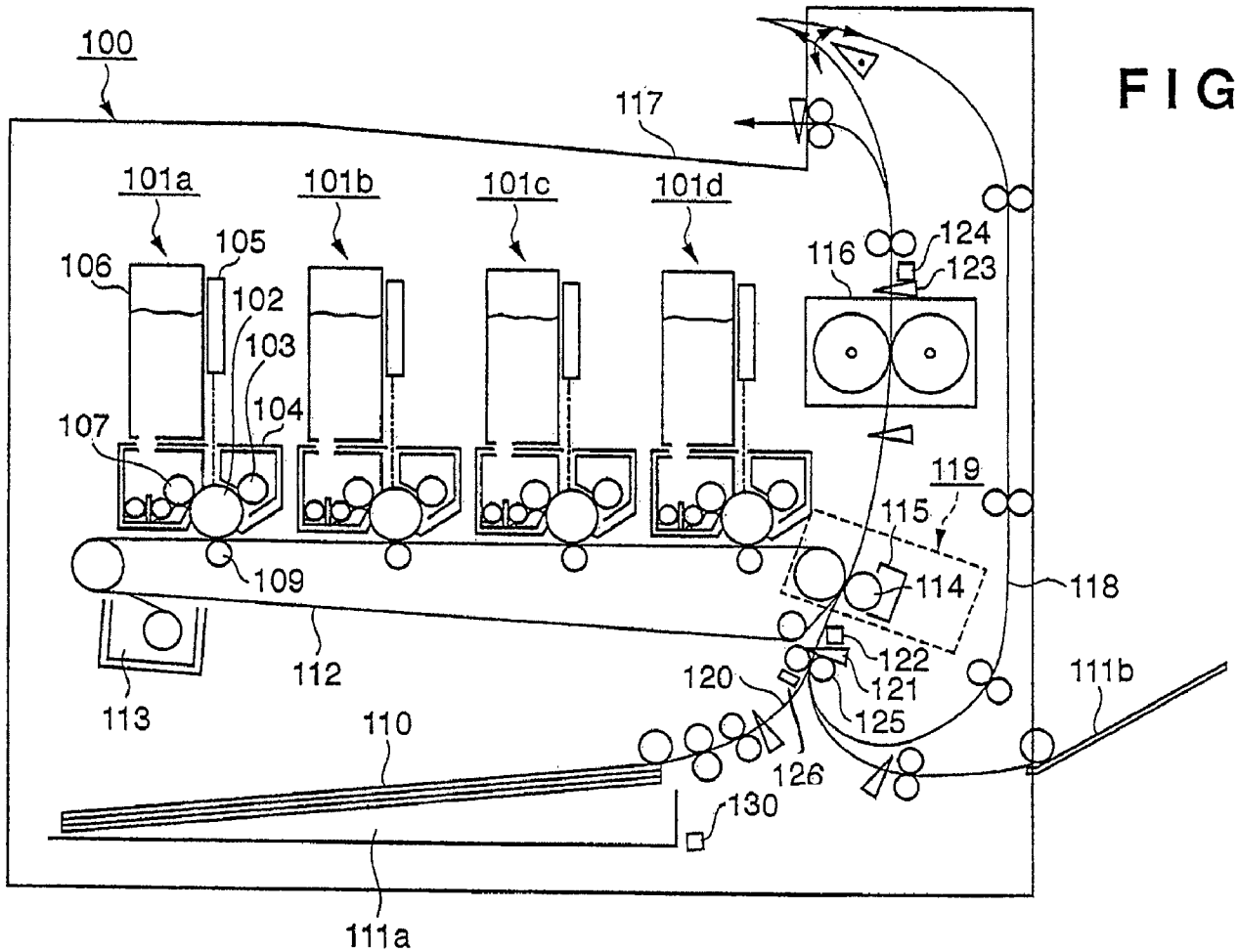
FIG. 1 is a sectional view showing an image forming apparatus according to the present invention.

FIG. 1 is a sectional view showing an image forming apparatus according to the present invention. The image forming apparatus according to the present invention is applied to an electrophotographic color image forming apparatus as one example. The image forming apparatus adopts an intermediate transfer scheme. Only parts related to the present invention will be described here.

An image forming apparatus 100 according to this embodiment includes four image forming units 101*a*, 101*b*, 101*c*, and 101*d*, intermediate transfer belt 112, waste toner container 113, secondary transferring unit 119, and fixing unit 116 as components to mainly form an image. The image forming units 101*a*, 101*b*, 101*c*, and 101*d* are disposed for respective stations which include developers of yellow (Y), magenta (M), cyan (C), and black (K). The image forming apparatus 100 further includes a paper feed cassette 111*a*, paper feed tray 111*b*, convey path 120, registration roller 125, paper discharge unit 117, and double-sided unit 118 as components to mainly convey a printing material 110. The image forming apparatus 100 further includes sub scanning direction sensors 121 and 123 and main scanning direction sensors 122 and 124 as components to detect the size of the printing material 110.

Since the four image forming units 101*a*, 101*b*, 101*c*, and 101*d* can adopt the same arrangement, one image forming unit will be explained below. The image forming unit 101 includes a photosensitive drum 102 which functions as an image carrier. The image forming unit 101 further includes a charger 104, an exposure unit 105, a developing device 106 serving as a developer carrier, and a primary transfer roller 109 along the rotation direction of the photosensitive drum 102 such that they oppose the outer surface of the photosensitive drum 102.

The image forming unit 101 causes the charger 104 having a charging roller 103 to charge the photosensitive drum 102 separately for the stations of yellow (Y), magenta (M), cyan (C), and black (K). The image forming unit 101 then forms an electrostatic latent image by exposure using the exposure unit 105, and forms a single-color developer image by developing the electrostatic latent image using a developing roller 107 of the developing device 106.

The circumferential outer surface of an aluminum cylinder of the photosensitive drum 102 is coated with an organic conductive layer so that the photosensitive drum 102 rotates upon receiving a driving force of a driving motor. The photosensitive drum 102 rotates counterclockwise in FIG. 1 in accordance with the developer image formation operation. The intermediate transfer belt 112 rotates clockwise to transfer a single-color developer image from the photosensitive drum 102 onto the intermediate transfer belt 112 as the photosensitive drum 102 and primary transfer roller 109 opposing it rotate. The image forming unit 101 then superposes single-color developer images to form a multicolor developer image on the intermediate transfer belt 112.

The secondary transferring unit 119 transfers the developer image formed on the intermediate transfer belt 112 onto the printing material 110. To secondarily transfer the developer image onto the printing material 110, the secondary transferring unit 119 has two secondary transfer rollers 114 arranged to oppose each other through the intermediate transfer belt 112. The secondary transfer rollers 114 are pressurized with an appropriate pressure to abut against the intermediate transfer belt 112, thereby secondarily transferring the developer image onto the conveyed printing material 110. A blade scrapes the toner which remains on the secondary transfer roller 114 upon secondary transfer. A waste toner container 115 stores the scraped toner as waste toner. The fixing unit 116 permanently fixes the image formed on the printing material 110.

Of the toner image formed to fall outside the size of the printing material in margin-less printing, the toner which is not transferred onto the printing material remains on the intermediate transfer belt 112. The waste toner container 113 disposed on the downstream side from the secondary transferring unit 119 along the driving direction of the intermediate transfer belt 112 stores this residual toner (also called waste toner).

The printing material 110 is fed from the paper feed cassette 111*a* or paper feed tray 111*b* and conveyed to the registration roller 125 through the convey path 120. In margin-less printing, the image forming apparatus 100 according to the present invention causes the main scanning direction sensor 122 to detect the dimension of the printing material 110 in the main scanning direction, while it causes the sub scanning direction sensor 121 to detect the dimension of the printing material 110 in the sub scanning direction. The image forming apparatus may include the main scanning direction sensor 124 and sub scanning direction sensor 123 disposed on the downstream side from the fixing unit 116 along the convey direction of the printing material 110. These sensors are effective to detect the dimensions of the printing material 110 in the main scanning direction and sub scanning direction, which shrinks upon fixing by heat and pressure of the fixing unit 116.

When the sensors detect the dimensions of the printing material 110 in the main scanning direction and sub scanning direction, the convey velocity of the printing material 110 is adjusted by the position of the registration roller 125 to match the leading edge positions of the printing material 110 and the developer image formed on the intermediate transfer belt 112. The sensors may detect the size of the printing material 110 after adjusting the convey velocity by the position of the registration roller 125. When the developer image on the intermediate transfer belt 112 is secondarily transferred onto the printing material 110, the fixing unit 116 fixes the developer image to the printing material 110 and it is discharged to the paper discharge unit 117. In double-sided printing, the image forming apparatus 100 conveys the printing material 110 output from the fixing unit 116 to the double-sided unit 118. The double-sided unit 118 turns over the conveyed printing material 110 and conveys it to the secondary transferring unit 119 again.

Figure 2:
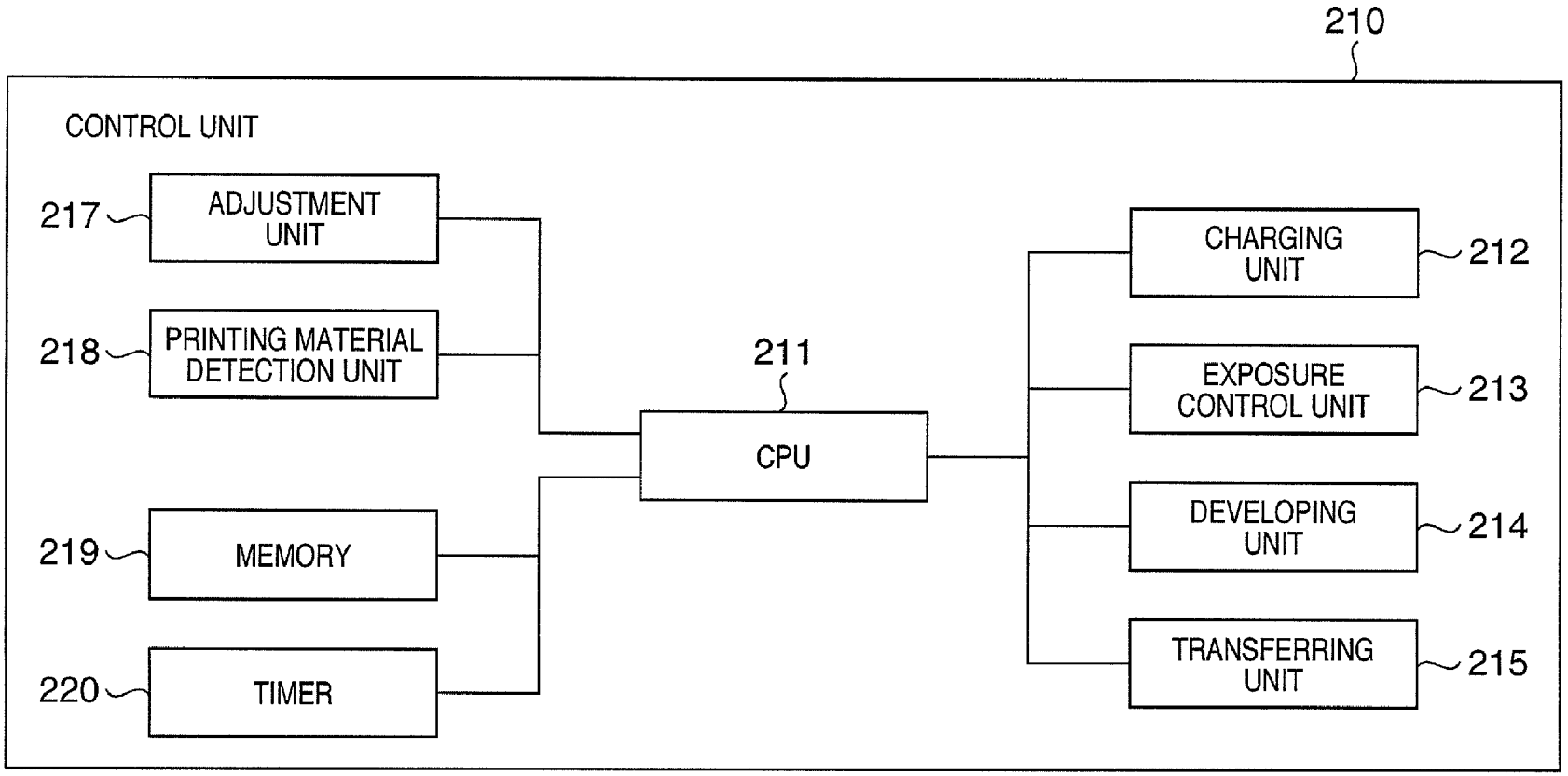
FIG. 2 is a block diagram showing the overall configuration of the image forming apparatus according to the present invention.

FIG. 2 is a block diagram showing the overall configuration of the image forming apparatus according to the present invention. Control of image formation of the image forming apparatus 100 in the present invention will be explained here.

The image forming apparatus includes a control unit 210. The control unit 210 includes a CPU 211, charging unit 212, exposure control unit 213, developing unit 214, transferring unit 215, adjustment unit 217, printing material detection unit 218, memory 219 (storage unit), and timer 220.

The control unit 210 causes the CPU 211 to control the charging unit 212, exposure control unit 213, developing unit 214, and transferring unit 215 associated with image formation. As described with reference to FIG. 1, the charging unit 212 controls the charger 104 to charge the photosensitive drum 102, and the exposure control unit 213 controls the exposure unit 105 in accordance with the input of an image signal (exposure time) to selectively expose the photosensitive drum 102. The developing unit 214 controls the developing device 106 to develop the electrostatic latent image formed on the photosensitive drum 102. The transferring unit 215 drives the intermediate transfer belt 112 clockwise to sequentially transfer the developer images formed on the photosensitive drum 102. The transferring unit 215 drives the intermediate transfer belt 112 to convey the formed developer images to the position of the secondary transferring unit 119.

The printing material detection unit 218 computes the dimensions of the printing material 110 in the main scanning direction and sub scanning direction on the basis of the signals output from the main scanning direction sensors 122 and 124 and sub scanning direction sensors 121 and 123. How to decide the dimensions of the printing material 110 in the main scanning direction and sub scanning direction will be described later with reference to FIGS. 5 and 6. The control unit 210 stores, in the memory 219, the size data of the printing material 110 detected by the printing material detection unit 218. The adjustment unit 217 functions as a setting unit to read out the size data of the printing material 110 stored in the memory 219, thereby adjusting the size of a developer image to be formed. The timer 220 is used to measure, e.g., the time from when the leading edge of the printing material 110 reaches the sub scanning direction sensors 121 and 123 until its trailing edge reaches them.

Figure 3A:
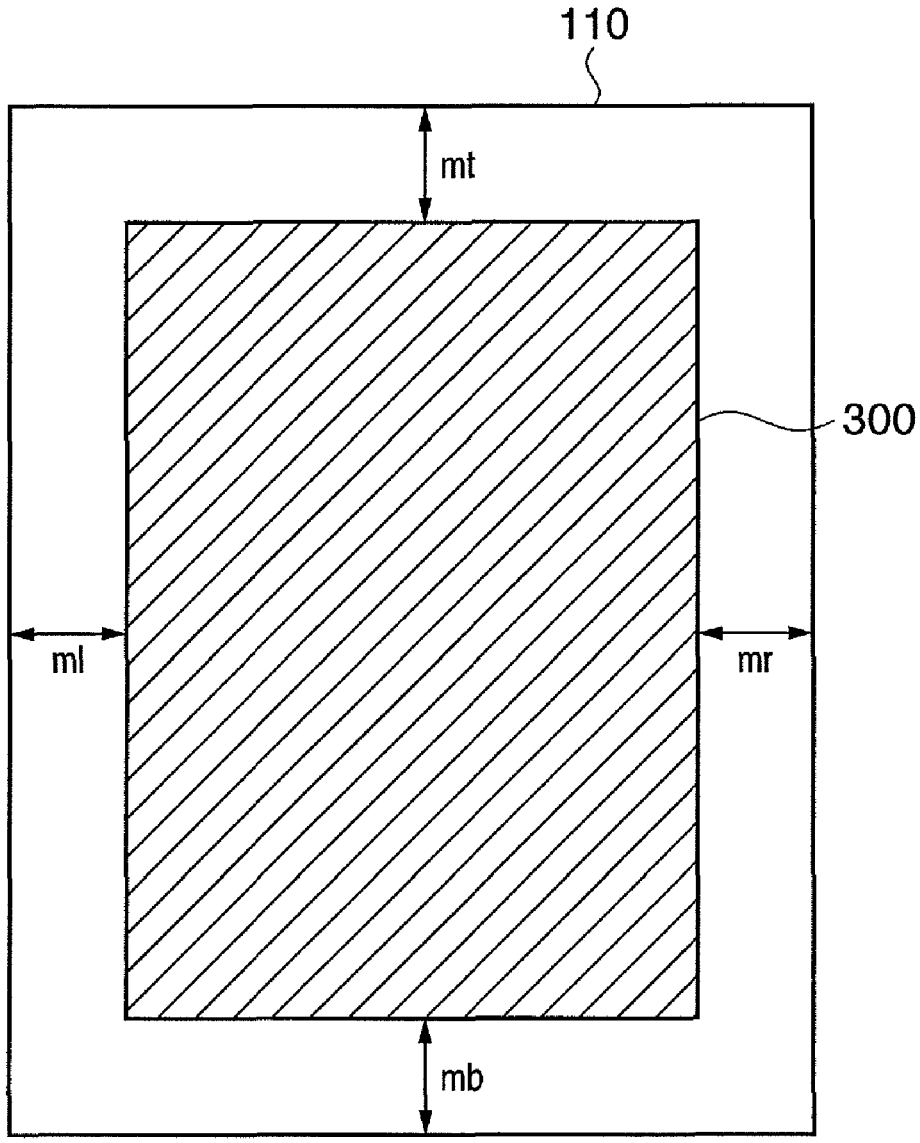
FIG. 3A is a view showing a printed with margin printing material in the image forming apparatus.
Figure 3B:
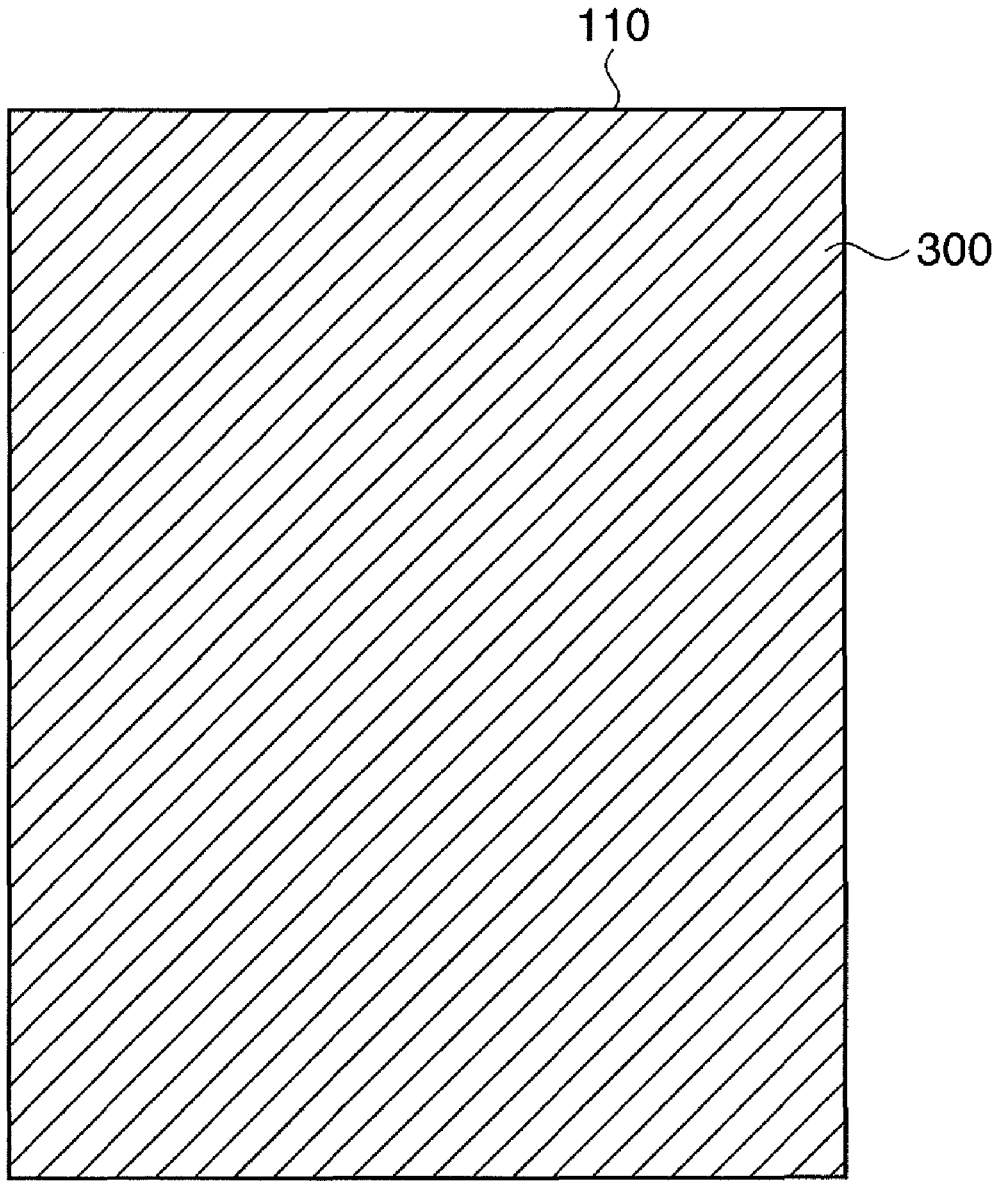
FIG. 3B is a view showing a printed without margin printing material in the image forming apparatus.

FIG. 3A is a view showing a printed with margin printing material in the image forming apparatus. FIG. 3B is a view showing a margin-less printed printing material in the image forming apparatus. Printing with margin and margin-less printing in the image forming apparatus will be explained here.

As shown in FIG. 3A, to execute printing with margin, a developer image 300 is formed to be smaller than it. That is, the printing material 110 on which the developer image 300 is formed has peripheral margins, i.e., an upper margin of mt, lower margin of mb, left margin of ml, and right margin of mr. The formed developer image 300 is wholly transferred onto the printing material 110 although the sizes of the developer image 300 and printing material 110 are slightly different. Hence, in printing with margin, no toner remains on the intermediate transfer belt 112 upon transferring the developer image 300 onto the printing material 110.

As shown in FIG. 3B, the developer image 300 is formed on the entire printing material 110 in margin-less printing. That is, the developer image 300 extends over the upper, lower, left, and right edges of the printing material 110 on which the developer image 300 is formed, so the printing material 110 has no peripheral margins. Although FIG. 3B shows a state in which the printing material 110 has none of the upper, lower, left, and right margins, it is merely one application example. Margin-less printing is applied unless the printing material 110 has all these margins. In margin-less printing, the printing material 110 after image formation may have a margin even when the developer image 300 is slightly misaligned. Hence, margin-less printing attaches a greater importance to the size of the developer image 300 to be formed than in printing with margin.

FIGS. 4A, 4B, 4C, and 4D are views showing image formation in margin-less printing in the image forming apparatus. When one selects margin-less printing, the adjustment unit 217 adjusts the size of a developer image to be formed, in accordance with the dimensions of the selected printing material 110 in the main scanning direction and sub scanning direction.

Figure 4A:
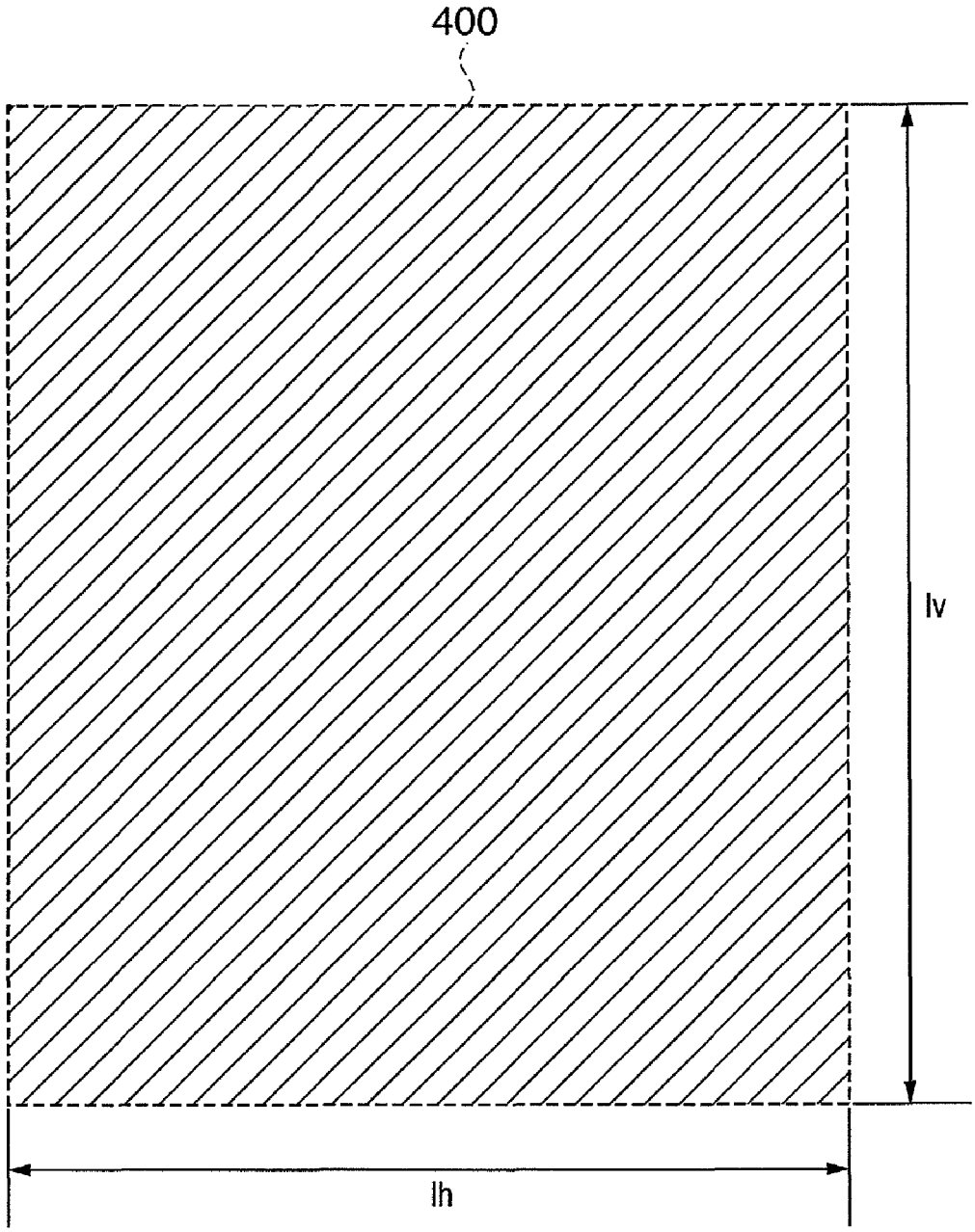
FIG. 4A is a view showing image formation in margin-less printing of the image forming apparatus.
Figure 4B:
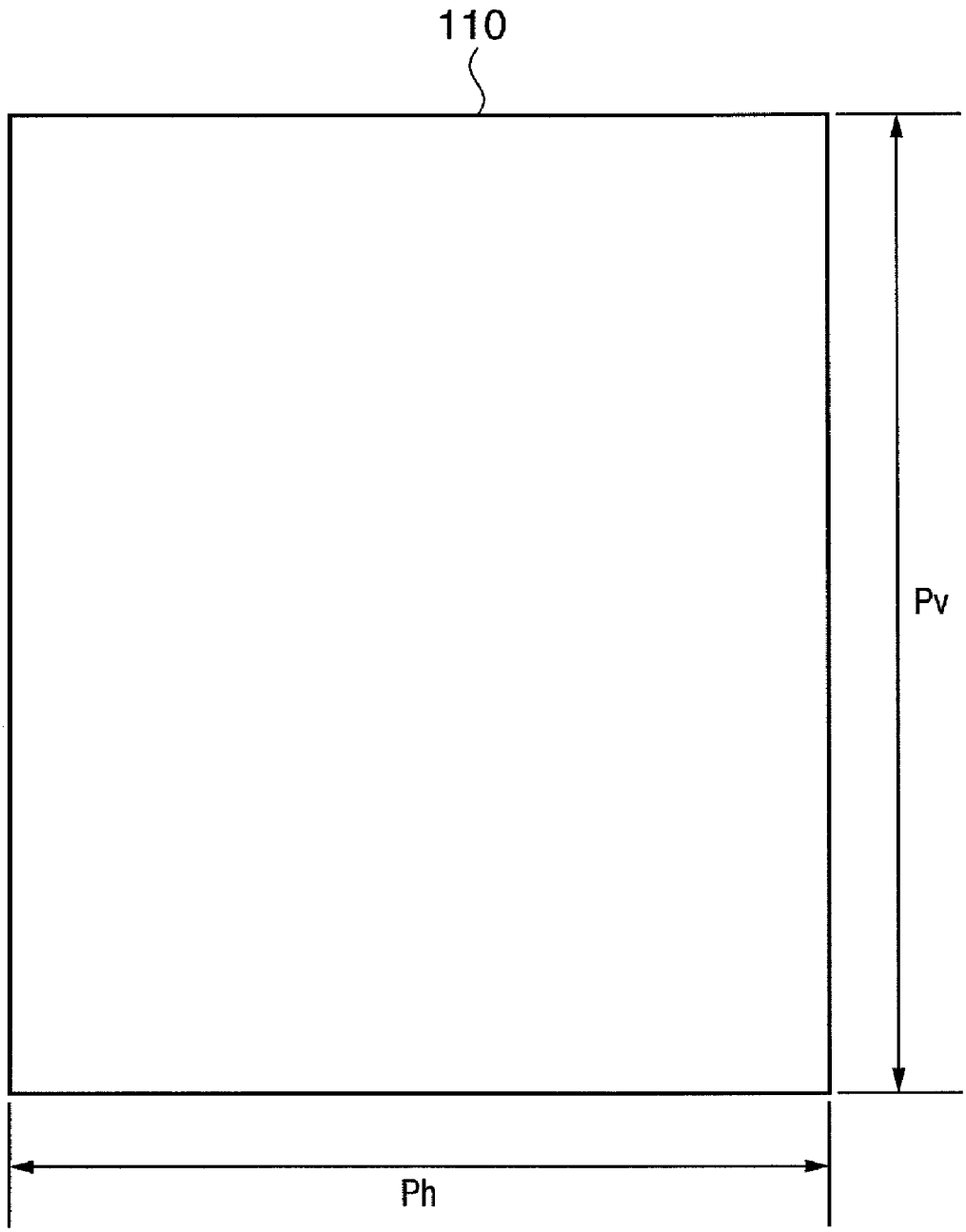
FIG. 4B is a view showing another image formation in margin-less printing of the image forming apparatus.

FIG. 4A is a view showing the size of a developer image formed on an intermediate transfer belt. A developer image 400 has a size defined by a vertical dimension Iv and horizontal dimension Ih. FIG. 4B is a view showing the size of a printing material. The printing material 110 has a size defined by a vertical dimension Pv and horizontal dimension Ph. The relationship between the sizes of the developer image 400 and the printing material 110 satisfies Pv<Iv and Ph<Ih.

Figure 4C:
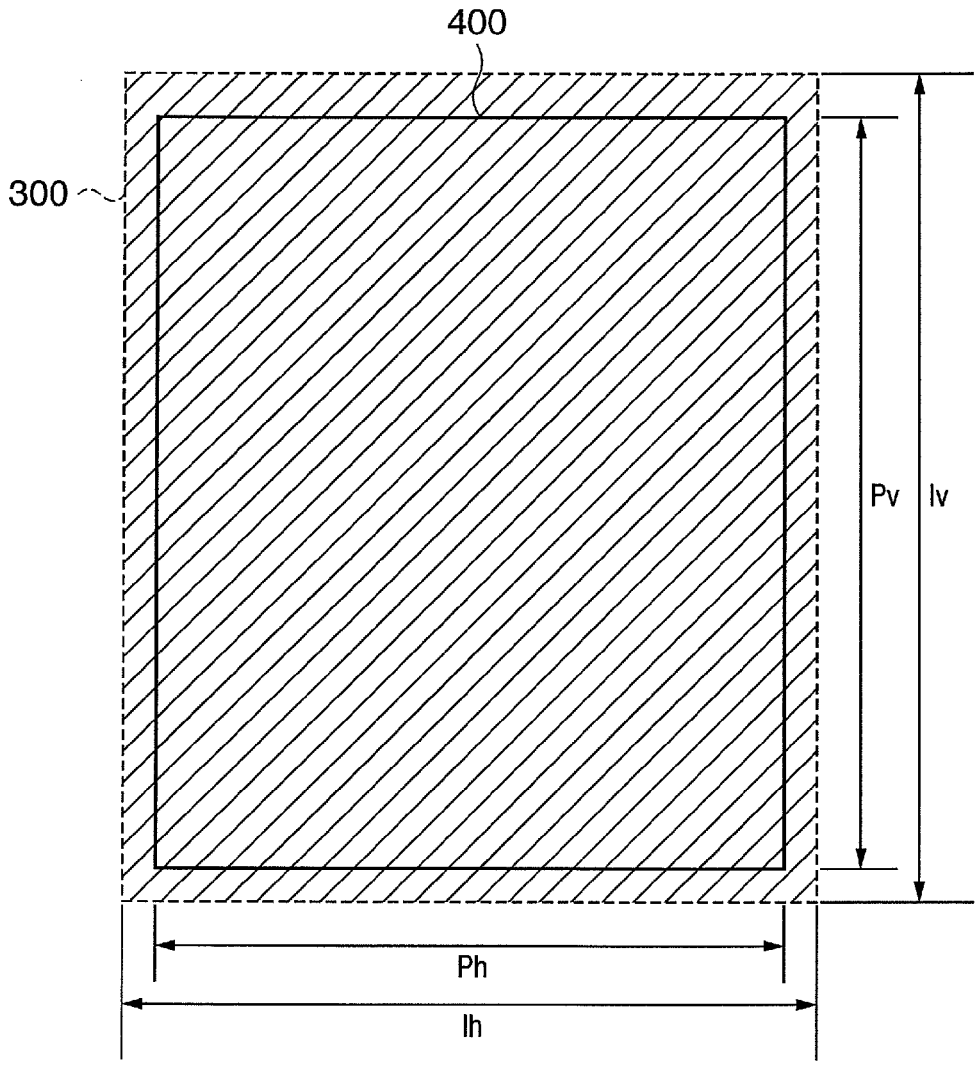
FIG. 4C is a view showing still another image formation in margin-less printing of the image forming apparatus.

FIG. 4C is a view showing a state in which a secondary transferring unit transfers a developer image onto a printing material. As shown in FIG. 4C, the developer image 400 is formed to fall outside the size of the printing material 110. This is to prevent the printing material 110 after formation from having margins even when the secondary transferring unit transfers the developer image 400 to the printing material 110 while their positions are slightly misaligned. That is, the adjustment unit 217 adjusts an image signal for forming a developer image to be larger than the printing material 110.

Figure 4D:
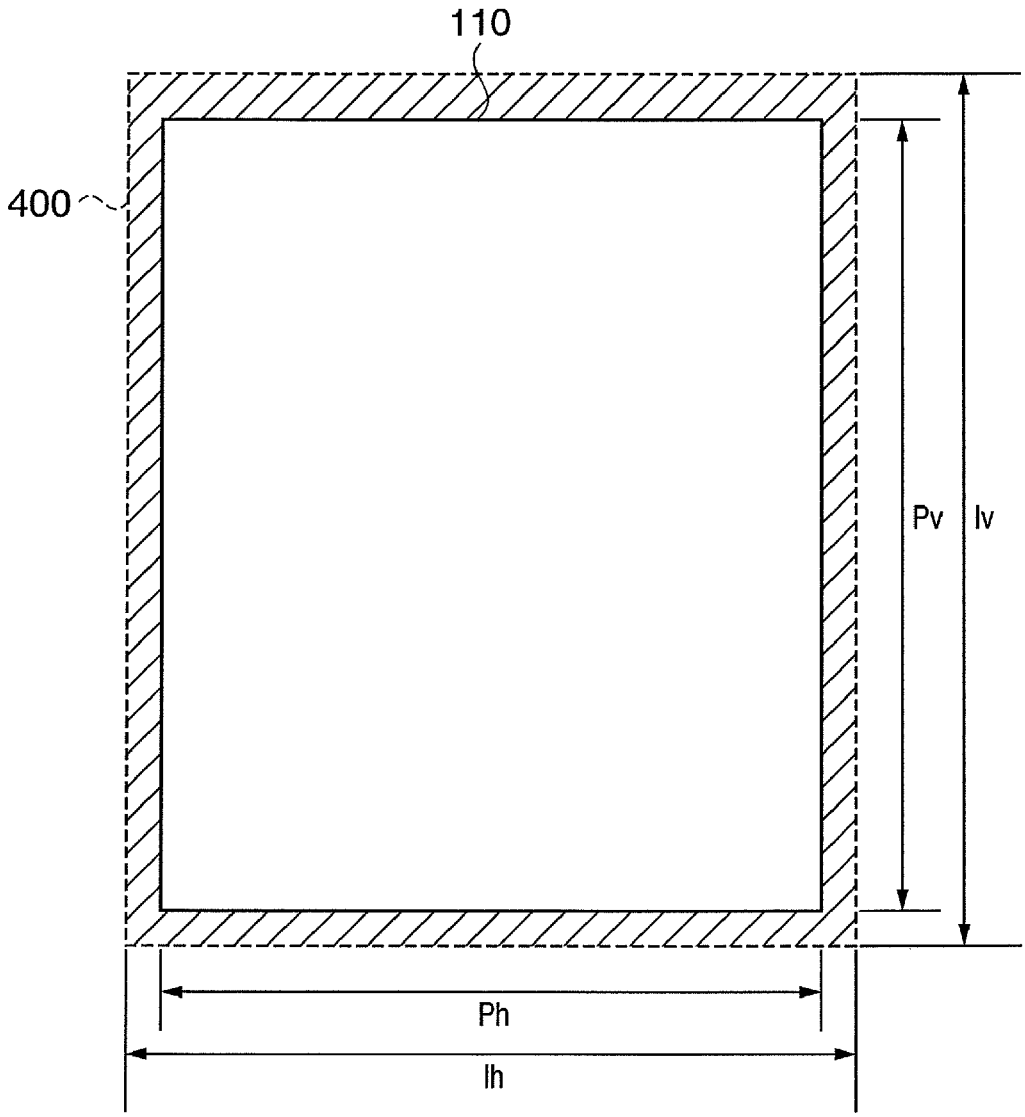
FIG. 4D is a view showing still another image formation in margin-less printing of the image forming apparatus.

FIG. 4D is a view showing residual toner after secondary transfer. As shown in FIG. 4D, frame-like toner which is not transferred onto the printing material remains on the intermediate transfer belt 112 after secondary transfer. As described above, in margin-less printing, that portion of the toner which is formed outside the size of the printing material 110 is not transferred onto the printing material 110 but adheres to the secondary transfer roller. The image forming apparatus 100 wastefully consumes the toner adhering to the secondary transfer roller. To solve this problem, the image forming apparatus 100 must minimize a region where the developer image is formed outside the printing material 110.

Figure 5:
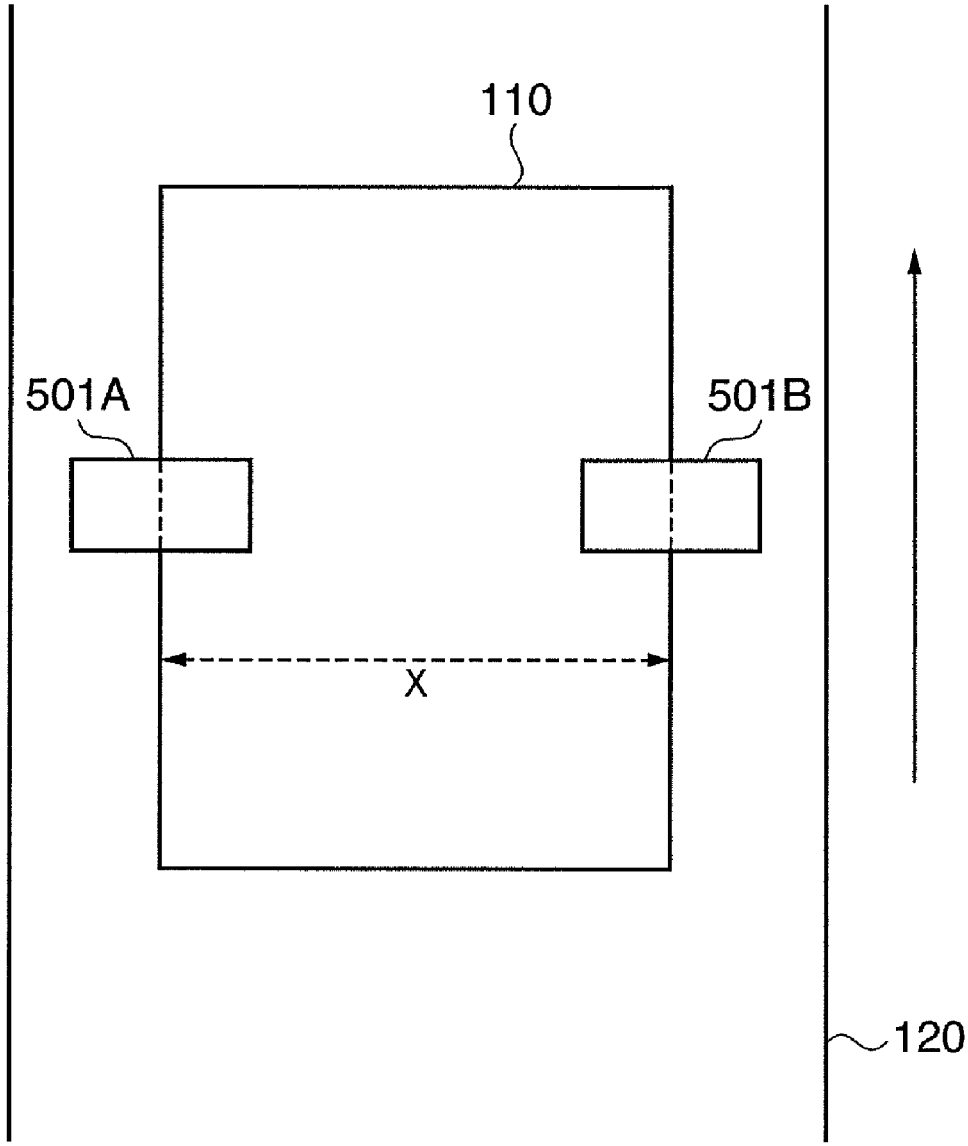
FIG. 5 is a view showing how to detect the dimension of a printing material in the main scanning direction in a printing material detection unit.

FIG. 5 is a view showing how to detect the dimension of a printing material in the main scanning direction in a printing material detection unit. A method of detecting the dimension of a printing material in the main scanning direction using two line sensors 501A and 501B, to which the main scanning direction sensors 122 and 124 in the present invention are applied as one example and which are juxtaposed in a orthogonal direction to the convey direction of the printing material 110, will be explained here. However, the main scanning direction sensors 122 and 124 according to the present invention are not limited to this example. It suffices that the main scanning direction sensors 122 and 124 can detect the dimension of the printing material 110 in the main scanning direction.

The line sensors 501A and 501B are aligned on the main scanning line of the convey path 120, as shown in FIG. 5. Each of the line sensors 501A and 501B detects the position of the printing material 110 relative to the line sensor 501A or 501B when it passes under the line sensor 501A or 501B. Each of the main scanning direction sensors 122 and 124 outputs a signal indicating a position under the line sensor 501A or 501B, where the edge of the conveyed printing material 110 in the main scanning direction has passed. More specifically, the line sensors 501A and 501B output a signal representing, e.g., an 8-bit analog value. If the convey range of the printing material 110 corresponds to the whole line sensor, the output signal is FFh. If the convey range of the printing material 110 does not correspond to the line sensor at all, the output value is 00h. The line sensors 501A and 501B output a signal representing a value of 80h in FIG. 5, because the convey range of the printing material 110 corresponds to a half size of the line sensor. When the line sensors 501A and 501B detect the convey range of the printing material 110, the printing material detection unit 218 computes the dimension of the printing material 110 in the main scanning direction, over which the convey range corresponds to the line sensor 501, on the basis of the signals output from the line sensors 501A and 501B. The printing material detection unit 218 adds the distance between the line sensors 501A and 501B and the computed dimension of the printing material 110 in the main scanning direction, over which the convey range corresponds to the line sensor 501, thereby computing the dimension of the printing material 110 in the main scanning direction.

Figure 6:
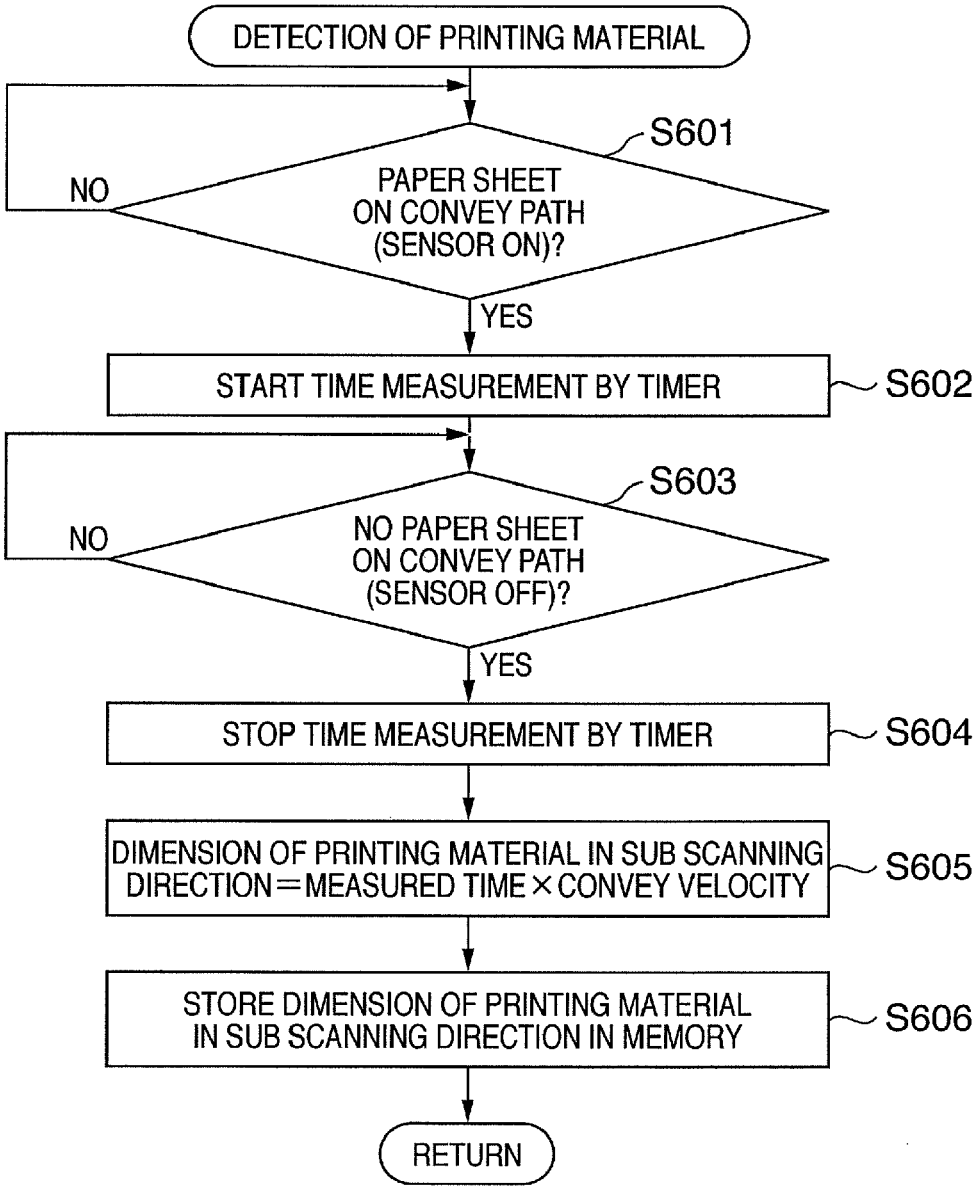
FIG. 6 is a flowchart showing control for detecting the dimension, in the sub scanning direction, of a printing material in a printing material detection unit.

FIG. 6 is a flowchart showing control for detecting the dimension, in the sub scanning direction, of a printing material in a printing material detection unit. The sub scanning direction sensors 121 and 123 have the same arrangement as that of a normal registration sensor, and include a flag serving as a member which operates as a printing material passes, and a photo-interruptor for detecting the flag operation. The sub scanning direction sensors 121 and 123 output a sensor ON signal when the printing material 110 is conveyed, and output a sensor OFF signal when the printing material 110 has passed on the sensor. The signal output from the sub scanning direction sensor 121 is also used in registration processing for causing the secondary transferring unit 119 to match the leading edges of the printing material 110 and the developer image formed on the intermediate transfer belt 112.

The printing material detection unit 218 repeatedly determines in step S601 whether the signal output from the sub scanning direction sensor 121 is ON until it becomes ON. If the signal output from the sub scanning direction sensor 121 becomes ON, the printing material detection unit 218 instructs the timer 220 to start time measurement in step S602. That is, the printing material detection unit 218 causes the timer 220 to start time measurement when the leading edge of the printing material 110 has reached the sub scanning direction sensor 121.

The printing material detection unit 218 repeatedly determines in step S603 whether the signal output from the sub scanning direction sensor 121 is OFF until it becomes OFF. If the signal output from the sub scanning direction sensor 121 becomes OFF, the printing material detection unit 218 instructs the timer 220 to stop time measurement in step S604. That is, the printing material detection unit 218 causes the timer 220 to stop time measurement at the timing when the trailing edge of the printing material 110 passes through the sub scanning direction sensor 121. The printing material detection unit 218 acquires the measured time from the timer 220.

In step S605, the printing material detection unit 218 computes the dimension of the printing material 110 in the sub scanning direction by multiplying the acquired time by the convey velocity of the printing material 110. Upon computing the dimension of the printing material 110 in the sub scanning direction, the printing material detection unit 218 stores the computed value in the memory 219 in step S606.

First Embodiment

An image forming apparatus according to the first embodiment will be described below. The image forming apparatus in this embodiment detects the size of a printing material 110 during printing on the first page in double-sided printing without margin for a printing material whose size is unknown. The image forming apparatus adjusts the size of a developer image to be formed, on the basis of the detected size of the printing material 110 in margin-less printing on the second page.

Figure 7:
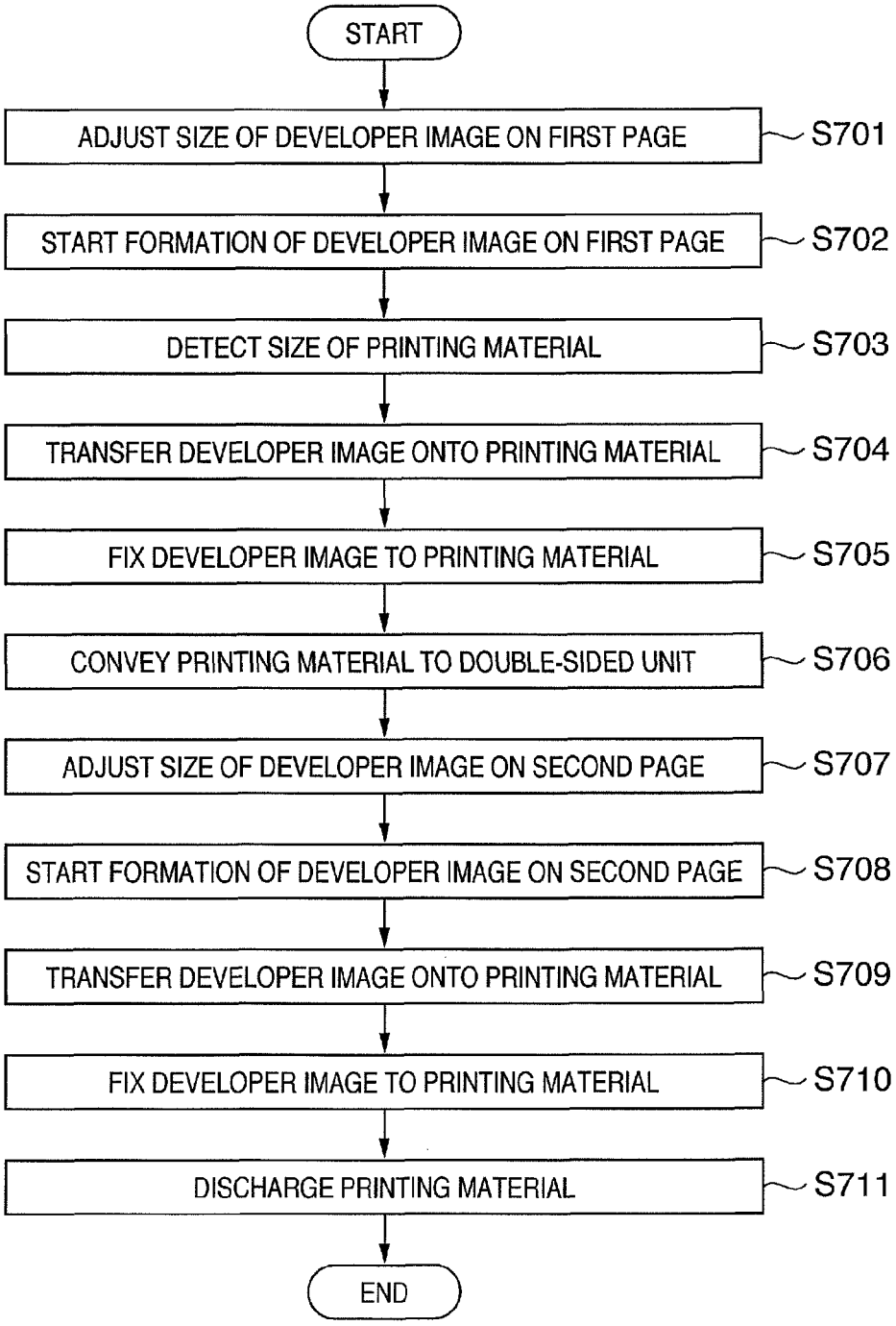
FIG. 7 is a flowchart showing control of image formation of an image forming apparatus according to the first embodiment.

FIG. 7 is a flowchart showing control of image formation of the image forming apparatus according to the first embodiment. A case wherein double-sided printing without margin is selected will be explained here.

When a paper feed cassette 111*a* or paper feed tray 111*b* starts feeding paper to form an image on the first page, an adjustment unit 217 adjusts the size of a developer image to be formed on an intermediate transfer belt 112 in step S701. If the size of the printing material 110 is unknown when, e.g., the paper feed tray 111*b* feeds the printing material 110, the adjustment unit 217 adjusts the size of the developer image to match the maximum size of a printing material printable by an image forming apparatus 100. In this case, the size of the developer image is a value obtained by adding a peripheral margin and the maximum size of a printable printing material.

As the adjustment unit 217 adjusts the size of the developer image, an image forming unit 101 starts processing for forming a developer image on the intermediate transfer belt 112 in step S702. When the fed printing material 110 is conveyed to the positions of a main scanning direction sensor 122 and sub scanning direction sensor 121, a printing material detection unit 218 detects the dimensions of the printing material 110 in the main scanning direction and sub scanning direction in step S703. The printing material detection unit 218 stores the detected dimensions of the printing material 110 in the main scanning direction and sub scanning direction in a memory 219. In step S704, a transferring unit 215 adjusts the driving velocity of the intermediate transfer belt 112 and the convey velocity of the printing material 110, and a secondary transferring unit 119 transfers the developer image onto the printing material 110. As the secondary transferring unit 119 transfers the developer image onto the printing material 110, a CPU 211 controls a fixing unit 116 to fix the developer image to the printing material 110 by heat and pressure in step S705.

In step S706, the CPU 211 conveys the printing material 110 to a double-sided unit 118 to form an image on the second page. The double-sided unit 118 turns over the conveyed printing material 110 and conveys it to the secondary transferring unit 119 again to form an image on the second page. In step S707, the adjustment unit 217 adjusts the size of a developer image to be formed on the second page of the printing material 110. During image formation on the first page, the adjustment unit 217 reads out, from the memory 219, the dimensions of the printing material 110 in the main scanning direction and sub scanning direction, that are detected in step S703, and adjusts the size of the developer image on the basis of the readout value.

For margin-less printing, the adjustment unit 217 adjusts the size of the developer image to be larger than the detected size of the printing material 110. A region where the developer image falls outside the size of the printing material 110 is formed within the allowable range of misalignment of the convey range of the printing material 110 in the image forming apparatus 100. That is, the adjustment unit 217 adjusts the size of the developer image such that the printing material 110 after image formation does not have a margin at its edge even when the convey range of the printing material 110 is slightly misaligned.

In step S708, on the intermediate transfer belt 112, the image forming unit 101 forms a developer image to be formed on the second page of the printing material 110 in accordance with the size of the developer image adjusted by the adjustment unit 217. In steps S709 and S710, like steps S704 and S705, the developer image is transferred onto the printing material 110 and fixed to it by heat and pressure. Finally, in step S711, the image forming apparatus 100 discharges the double-sided printed printing material 110 to a paper discharge unit 117.

Figure 8:
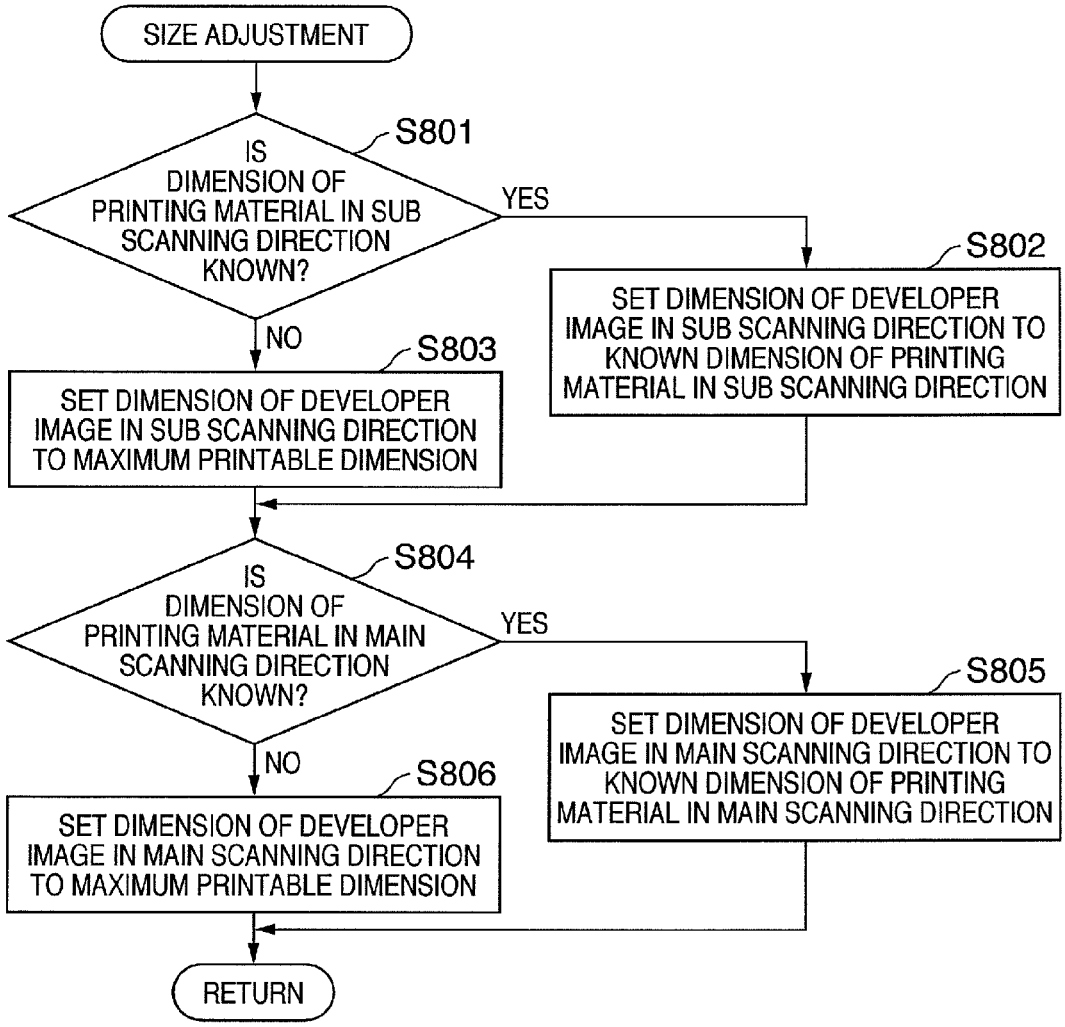
FIG. 8 is a flowchart showing control of an adjustment unit in the first embodiment.

FIG. 8 is a flowchart showing control of an adjustment unit in the first embodiment. Control of the adjustment unit 217 in this embodiment will be explained here. Processes to be descried hereinafter correspond to the detailed processes in steps S701 and S707 shown in FIG. 7.

The adjustment unit 217 determines in step S801 whether the dimension of the printing material 110 in the sub scanning direction is known. A case wherein the dimension of the printing material 110 in the sub scanning direction is known includes, e.g., a case wherein the image forming apparatus has an arrangement which can automatically detect the size of the printing material 110 as the printing material 110 is set in the paper feed cassette 111*a* and has already completed detection. As another case, the user may start printing by designating the size of the printing material 110, or the printing material detection unit 218 in this embodiment may have already detected the size of a printing material of the same type having been fed in the past.

If the dimension of the printing material 110 in the sub scanning direction is known, the adjustment unit 217 decides, as the dimension of the developer image in the sub scanning direction, a dimension obtained by adding a peripheral margin to the known dimension of the printing material 110 in the sub scanning direction in step S802. If the size of the printing material 110 is unknown, the adjustment unit 217 decides, as the dimension of the developer image in the sub scanning direction, a dimension obtained by adding a peripheral margin to the maximum size of a printing material printable by the image forming apparatus 100 in step S803.

The adjustment unit 217 determines in step S804 whether the dimension of the printing material 110 in the main scanning direction is known. If the dimension of the printing material 110 in the main scanning direction is known, the adjustment unit 217 decides, as the dimension of the developer image in the main scanning direction, a dimension obtained by adding a peripheral margin to the known dimension of the printing material 110 in the main scanning direction in step S805. If the dimension of the printing material 110 in the main scanning direction is unknown, the adjustment unit 217 decides, as the dimension of the developer image in the main scanning direction, a dimension obtained by adding a peripheral margin to the maximum size of a printing material printable by the image forming apparatus 100 in step S806.

FIG. 9 is a table showing information stored in a memory in the first embodiment. How to store the sizes of printing materials 110 set in the paper feed cassette 111*a* and paper feed tray 111*b* will be explained here. The paper feed cassette 111*a* comprises a plurality of paper feed cassettes, so it can stack printing materials having a variety of sizes at the same time.

As shown in FIG. 9, the memory 219 stores the size of the printing material 110 set for each of the paper feed cassette and paper feed tray. The storage timing is the moment when the printing material detection unit 218 detects the size of a fed printing material 110. Alternatively, the storage timing may be the moment when a printing material 110 is newly set if the image forming apparatus has an arrangement which can detect its size, or may be the moment when the user inputs the size of a printing material 110.

The information to be stored includes the dimensions in the sub scanning direction and main scanning direction unique to the paper feed cassette 111*a* and paper feed tray 111*b*. As indicated by cassette 2 in FIG. 9, the memory 219 may store only one of the dimensions in the main scanning direction and sub scanning direction. When the size of the set printing material 110 is unknown, the memory 219 may store a flag value indicating it. The adjustment unit 217 adjusts, as the size of the developer image, a size obtained by adding a peripheral margin to the maximum size of a printing material printable by the image forming apparatus 100.

The paper feed cassette 111 a desirably includes a sensing unit 130 (as shown in FIG. 1), which senses that the paper feed cassette 111*a* is detached from the apparatus main body. This is to newly sense the size of a printing material 110 which has a new size and may be set upon detaching the paper feed cassette 111*a*. In view of this, when the sensing unit 130 senses that the paper feed cassette 111*a* is detached, the stored information is desirably deleted in correspondence with the feed cassette 111*a*.

As has been described above, the image forming apparatus according to this embodiment includes an image forming unit which forms a developer image to be larger than a printing material when the image is to be formed on the printing material in a margin-less manner. The image forming apparatus further includes a transferring unit which transfers the developer image onto the printing material, and a fixing unit which fixes the developer image transferred by the transferring unit to the printing material. The image forming apparatus further includes a double-sided unit which turns over the printing material output from the fixing unit and conveys it to the transferring unit again. The image forming unit further includes an adjustment unit which adjusts the size of a developer image on the second page of the printing material to be smaller than that of a developer image on the first page of the printing material. Hence, the image forming apparatus can reduce the amount of toner which forms a developer image on the second page as compared with the amount of toner which forms a developer image on the first page.

The present invention is not limited to the above embodiment, and various modifications may be made. For example, the image forming apparatus may further include a printing material detection unit which detects the dimensions of a conveyed printing material in the main scanning direction and sub scanning direction during image formation on the first page of the printing material. The image forming apparatus may further include a storage unit which stores the dimensions of the printing material in the main scanning direction and sub scanning direction, that are detected by the printing material detection unit upon printing on the first page. The adjustment unit may adjust the size of a developer image to be formed on the second page of the printing material, on the basis of the dimensions of the printing material in the main scanning direction and sub scanning direction upon printing on the first page, that are stored in the storage unit. When the image forming apparatus is to form a developer image on the second page of the printing material with double-sided printing without margin, it adjusts the size of the developer image on the basis of the dimensions of the printing material in the main scanning direction and sub scanning direction, that are detected at the time of image formation on the first page. Hence, the image forming apparatus can reduce the toner consumption amount for the second page of the printing material even when its size is unknown.

The printing material detection unit may include a first sensor which detects the dimensions of the printing material in the main scanning direction and sub scanning direction before the transferring unit transfers the developer image onto the first page of the printing material. The adjustment unit may adjust the size of a developer image to be formed on the second page of the printing material, on the basis of the dimensions of the printing material in the main scanning direction and sub scanning direction, that are detected by the first sensor. Hence, the image forming apparatus can reduce the toner consumption amount for the second page of the printing material even when its size is unknown.

The image forming apparatus may further include a paper feed unit having a plurality of paper feed cassettes. The storage unit stores the dimensions of the printing material in the main scanning direction and sub scanning direction, that are detected by the printing material detection unit, for each of the plurality of paper feed cassettes. The adjustment unit may adjust the size of a developer image to be formed, on the basis of the dimensions, in the main scanning direction and sub scanning direction, of a printing material of the same type having been fed from a specific paper feed cassette in the past, which are stored in the storage unit. Hence, the image forming apparatus can reduce the toner consumption amount in printing after detection by storing the size of a printing material detected for each of the plurality of paper feed cassettes.

The paper feed unit may include a sensing unit which senses whether the printing materials in the paper feed cassettes are changed. The image forming apparatus may delete dimension information of at least any of paper feed cassettes having a printing material which may be changed. Even when a printing material of a paper feed cassette is replaced, the image forming apparatus resets stored dimension information of the printing material, and detects the size of the current printing material again in printing. Hence, the image forming apparatus can maintain the precision of margin-less printing while reducing the toner consumption amount.

The first and second sensors may each include two main scanning direction sensors juxtaposed in a orthogonal direction to the convey direction of a printing material on the convey path to convey the printing material, and a sub scanning direction sensor arranged on the convey path. The two main scanning direction sensors detect the passage range of the printing material when it passes under the main scanning direction sensors. The sub scanning direction sensor detects whether the printing material passes on it. The image forming apparatus can accurately detect the dimensions of the printing material in the main scanning direction and sub scanning direction. Hence, the image forming apparatus can reduce the toner consumption amount even in margin-less printing while the size of the printing material is unknown.

The printing material detection unit may compute the dimension of the printing material in the main scanning direction on the basis of the distance between the two main scanning direction sensors and the passage range of the printing material detected by each of the two main scanning direction sensors. When the leading edge of the printing material has reached the sub scanning direction sensor, the timer starts time measurement. When the trailing edge of the printing material has passed through the sub scanning direction sensor, the timer stops time measurement. The printing material detection unit may compute the dimension of the printing material in the sub scanning direction on the basis of the convey velocity of the printing material and the time measured by the timer. The image forming apparatus can accurately detect the dimensions of the printing material in the main scanning direction and sub scanning direction. Hence, the image forming apparatus can reduce the toner consumption amount even in margin-less printing while the size of the printing material is unknown.

The transferring unit may execute registration processing for matching the positions of a developer image and printing material at the timing when the leading edge of the printing material reaches the sub scanning direction sensor, which is contained in the first sensor. The image forming apparatus can detect the leading edge of the printing material used in the registration processing while it causes the sub scanning direction sensor to detect the dimension of the printing material in the sub scanning direction in parallel. Hence, the image forming apparatus allows precise margin-less printing while maintaining the printing speed and reduction in toner consumption amount.

Second Embodiment

Figure 10:
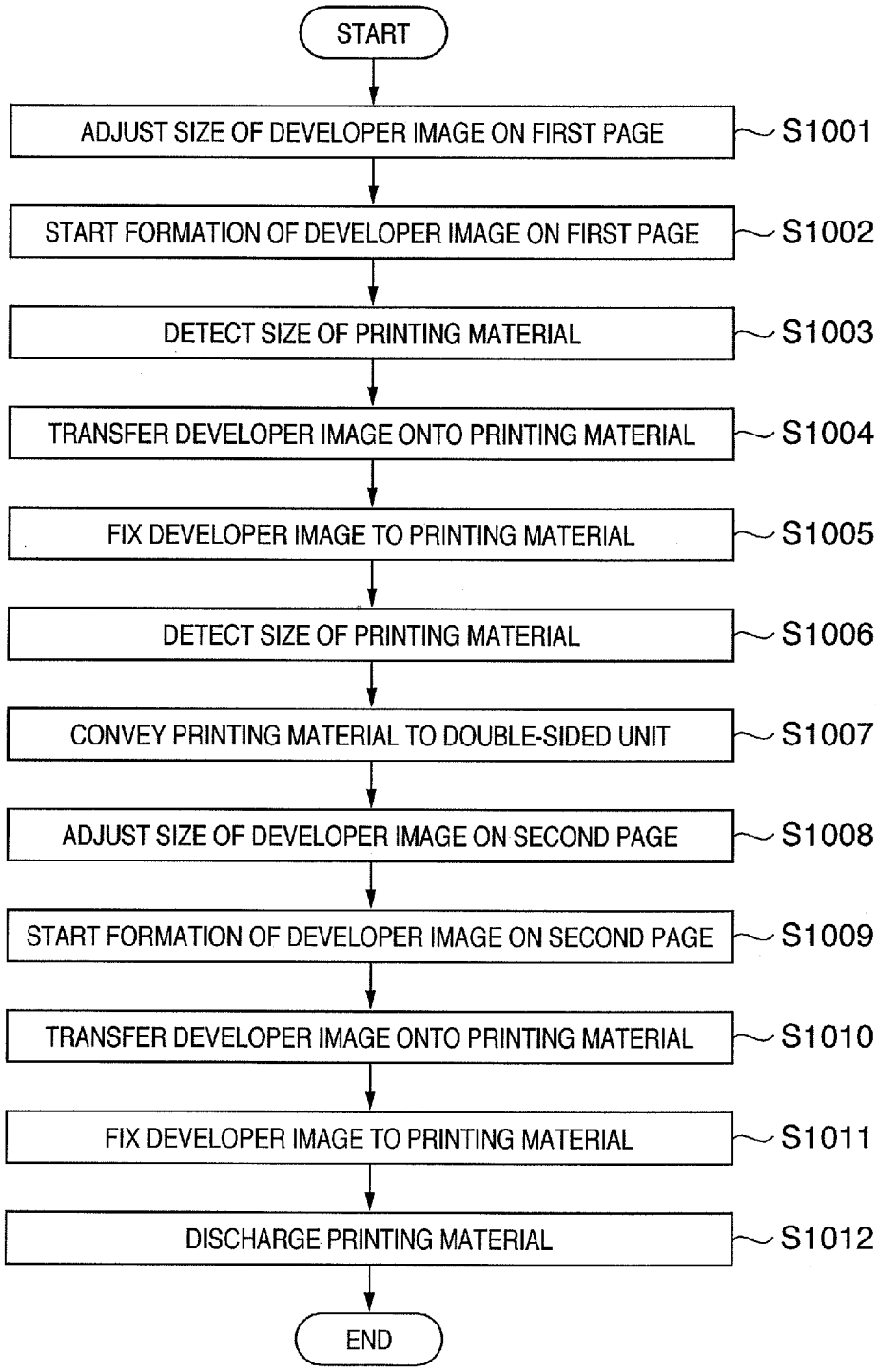
FIG. 10 is a flowchart showing control of image formation of an image forming apparatus according to the second embodiment.

FIG. 10 is a flowchart showing control of image formation of an image forming apparatus according to the second embodiment. According to this embodiment, at the time of image formation on the first page of a printing material 110, an adjustment unit 217 detects the size of the printing material 110 before transferring the developer image on the printing material 110 and after fixing the developer image to the printing material 110. A case wherein double-sided printing without margin is selected will be explained here. A description of processes which are the same as those in FIG. 7 will be omitted. Only steps S1006 and S1008 will be explained.

In step S1006, a printing material detection unit 218 causes a main scanning direction sensor 124 and sub scanning direction sensor 123 to detect the dimensions of the printing material 110 in the main scanning direction and sub scanning direction, that are output from a fixing unit 116. This detection is necessary because the fixing unit 116 fixes the developer image to the printing material 110 by heat and pressure, so the size of the printing material 110 slightly changes before and after fixing. The printing material detection unit 218 stores the detected dimensions of the printing material 110 in the main scanning direction and sub scanning direction in a memory 219.

In step S1008, the adjustment unit 217 adjusts the size of a developer image to be formed on the second page of the printing material 110. At this time, the adjustment unit 217 adjusts the size of the developer image to one obtained by adding a peripheral margin and the dimensions of the printing material 110 in the main scanning direction and sub scanning direction, that are detected in step S1006. This makes it possible to form a developer image corresponding to the size of the printing material 110 which has shrunken upon fixing. In step S1003, the size of the printing material detected before fixing is used to adjust the sizes of developer images to be formed on the first pages of printing materials subsequent to the first sheet.

Figure 11:
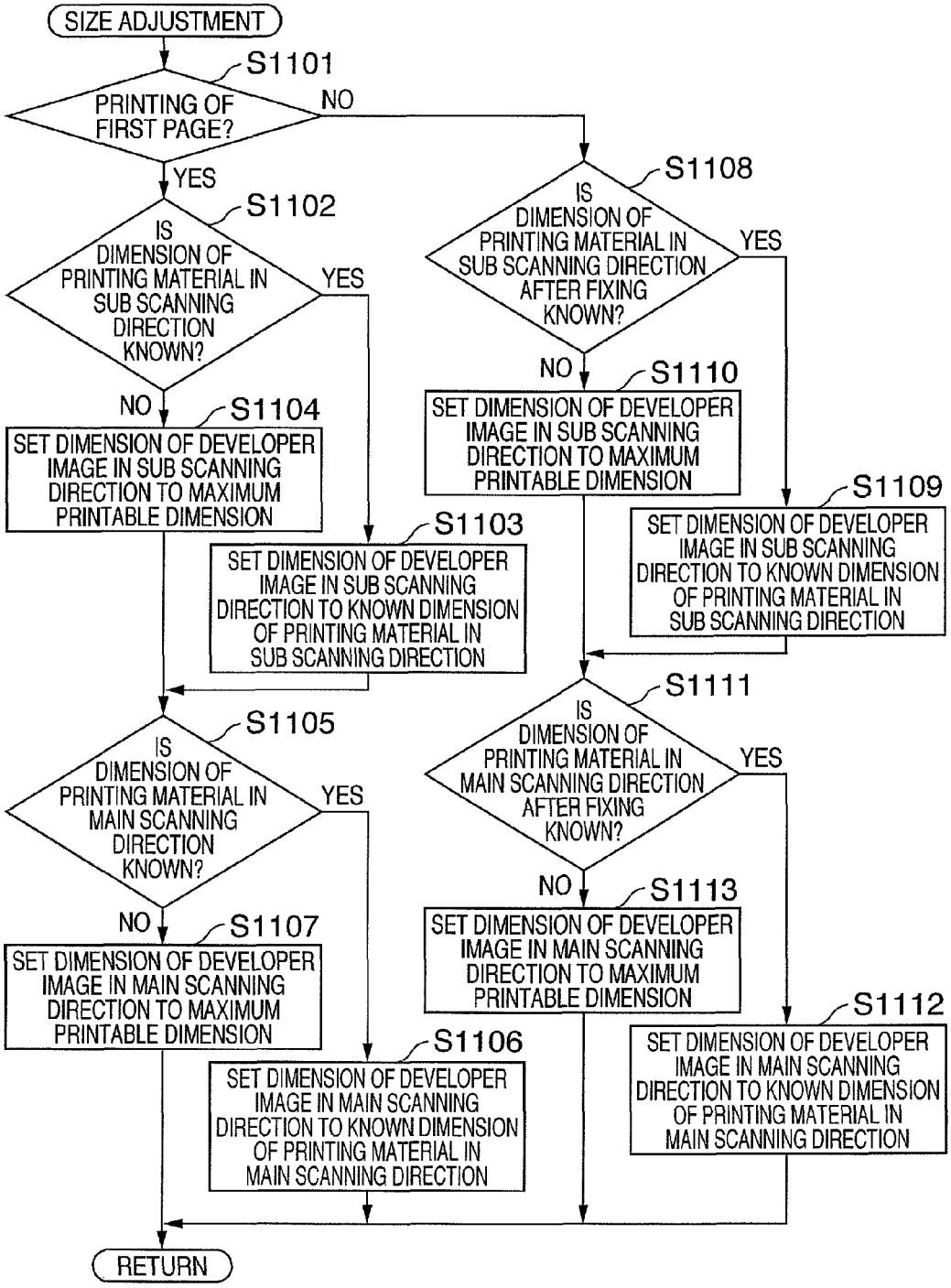
FIG. 11 is a flowchart showing control of an adjustment unit in the second embodiment.

FIG. 11 is a flowchart showing control of an adjustment unit in the second embodiment. Control of the adjustment unit 217 in this embodiment will be explained here. Processes to be descried hereinafter correspond to the detailed processes in steps S1001 and S1008 shown in FIG. 10. A description of processes which are the same as those in FIG. 8 will be omitted.

The adjustment unit 217 determines in step S1101 whether the first page of the printing material 110 is to be printed. If the first page is to be printed, the processes which are the same as those in FIG. 8 are done. That is, the processes from step S1102 to step S1107 correspond to those in step S801 to step S806, respectively. If the second page is to be printed, the adjustment unit 217 determines in step S1108 whether the dimension of the printing material 110 in the subscanning direction after fixing on the first page is known.

If the dimension of the printing material 110 in the sub scanning direction after fixing is known, the adjustment unit 217 decides, as the dimension of the developer image in the sub scanning direction, a dimension obtained by adding a peripheral margin to the known dimension of the printing material 110 in the sub scanning direction after fixing in step S1109. If the dimension of the printing material 110 in the sub scanning direction after fixing is unknown, the adjustment unit 217 decides, as the dimension of the developer image in the sub scanning direction, a dimension obtained by adding a peripheral margin to the maximum size of a printing material printable by an image forming apparatus 100 in step S1110. As a matter of course, like the first embodiment, if the dimension of the printing material 110 in the sub scanning direction before image formation is known, the adjustment unit 217 desirably decides, as the dimension of the developer image in the sub scanning direction, a dimension obtained by adding a peripheral margin and the dimension of the printing material 110 in the sub scanning direction.

The adjustment unit 217 determines in step 81111 whether the dimension of the printing material 110 in the main scanning direction after fixing on the first page is known. If the dimension of the printing material 110 in the main scanning direction after fixing is known, the adjustment unit 217 decides, as the dimension of the developer image in the main scanning direction, a dimension obtained by adding a peripheral margin to the known dimension of the printing material 110 in the main scanning direction after fixing in step S1112. If the dimension of the printing material 110 in the main scanning direction after fixing is unknown, the adjustment unit 217 decides, as the dimension of the developer image in the main scanning direction, a dimension obtained by adding a peripheral margin to the maximum size of a printing material printable by the image forming apparatus 100 in step S1113. Like the dimension of the printing material 110 in the sub scanning direction, if the dimension of the printing material 110 in the main scanning direction before image formation is known, the adjustment unit 217 desirably decides, as the dimension of the developer image in the main scanning direction, a dimension obtained by adding a peripheral margin and the dimension of the printing material 110 in the main scanning direction.

FIG. 12 is a table showing information stored in a memory in the second embodiment. How to store the sizes of printing materials 110 set in a paper feed cassette 111*a* and paper feed tray 111*b* in this embodiment will be explained here. A description of parts which are the same as those in FIG. 9 will be omitted.

As shown in FIG. 12, the memory 219 stores the size of the printing material 110 set for each of the paper feed cassette 111*a* and paper feed tray 111*b*. The memory according to this embodiment also stores the dimensions of the printing material 110 in the main scanning direction and sub scanning direction, that are detected before image formation on the first page of the printing material 110, and the dimensions of the printing material 110 in the main scanning direction and sub scanning direction, that are detected after fixing of the first page of the printing material 110.

As has been described above, the printing material detection unit according to this embodiment includes a first sensor which detects the dimensions of a printing material in the main scanning direction and sub scanning direction before the transferring unit transfers the developer image on the first page of the printing material. The printing material detection unit further includes a second sensor which detects the dimensions of the fixed printing material in the main scanning direction and sub scanning direction output from the fixing unit. On the basis of the dimensions of the printing material in the main scanning direction and sub scanning direction upon printing on the first page, that are detected by the first sensor, the adjustment unit adjusts the sizes of developer images to be formed on the first pages of printing materials subsequent to the first sheet. On the basis of the dimensions of the printing material in the main scanning direction and sub scanning direction after fixing, that are detected by the second sensor, the adjustment unit adjusts the size of a developer image to be formed on the second page of the printing material. On the basis of the size of the printing material detected after fixing on the first page, the image forming apparatus adjusts the size of the developer image at the time of image formation on the second page. Even when the printing material shrinks upon fixing on the first page by heat and pressure, the image forming apparatus adjusts the size of a developer image to be formed on the second page, on the basis of the size of the shrunken printing material. This makes it possible to further reduce the toner consumption amount.

Third Embodiment

Figure 13:
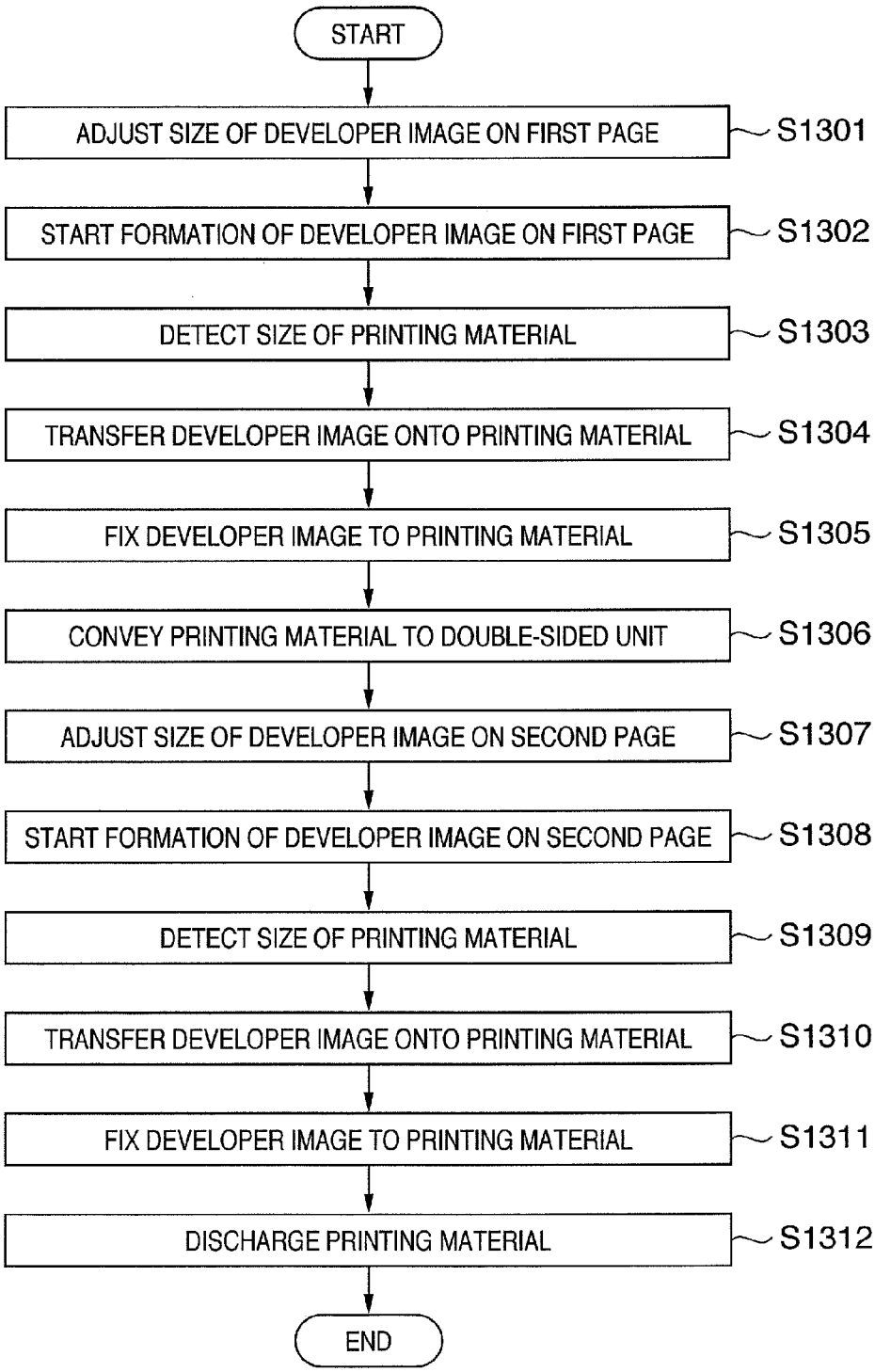
FIG. 13 is a flowchart showing control of image formation of an image forming apparatus according to the third embodiment.

FIG. 13 is a flowchart showing control of image formation of an image forming apparatus according to the third embodiment. According to this embodiment, an adjustment unit 217 detects the size of a printing material 110 at the time of image formation on the first page and second page of the first sheet of the printing material 110. A case wherein double-sided printing without margin is selected will be explained here. A description of processes which are the same as those in FIG. 7 will be omitted. Only step S1309 will be explained.

In step S1309, a printing material detection unit 218 causes a main scanning direction sensor 122 and sub scanning direction sensor 121 to detect the dimensions of the printing material 110 in the main scanning direction and sub scanning direction before image formation on the second sheet of the printing material 110. Like the second embodiment, this detection is necessary because the fixing unit 116 fixes the developer image to the printing material 110 by heat and pressure at the time of image formation on the first page, so the size of the printing material 110 slightly changes before and after fixing. The printing material detection unit 218 stores the detected dimensions of the printing material 110 in the main scanning direction and sub scanning direction in a memory 219. According to this embodiment, the adjustment unit uses the size of the printing material 110 detected before image formation on the second page of the printing material 110 to adjust the sizes of developer images on the second pages of printing materials 110 subsequent to the first sheet.

Figure 14:
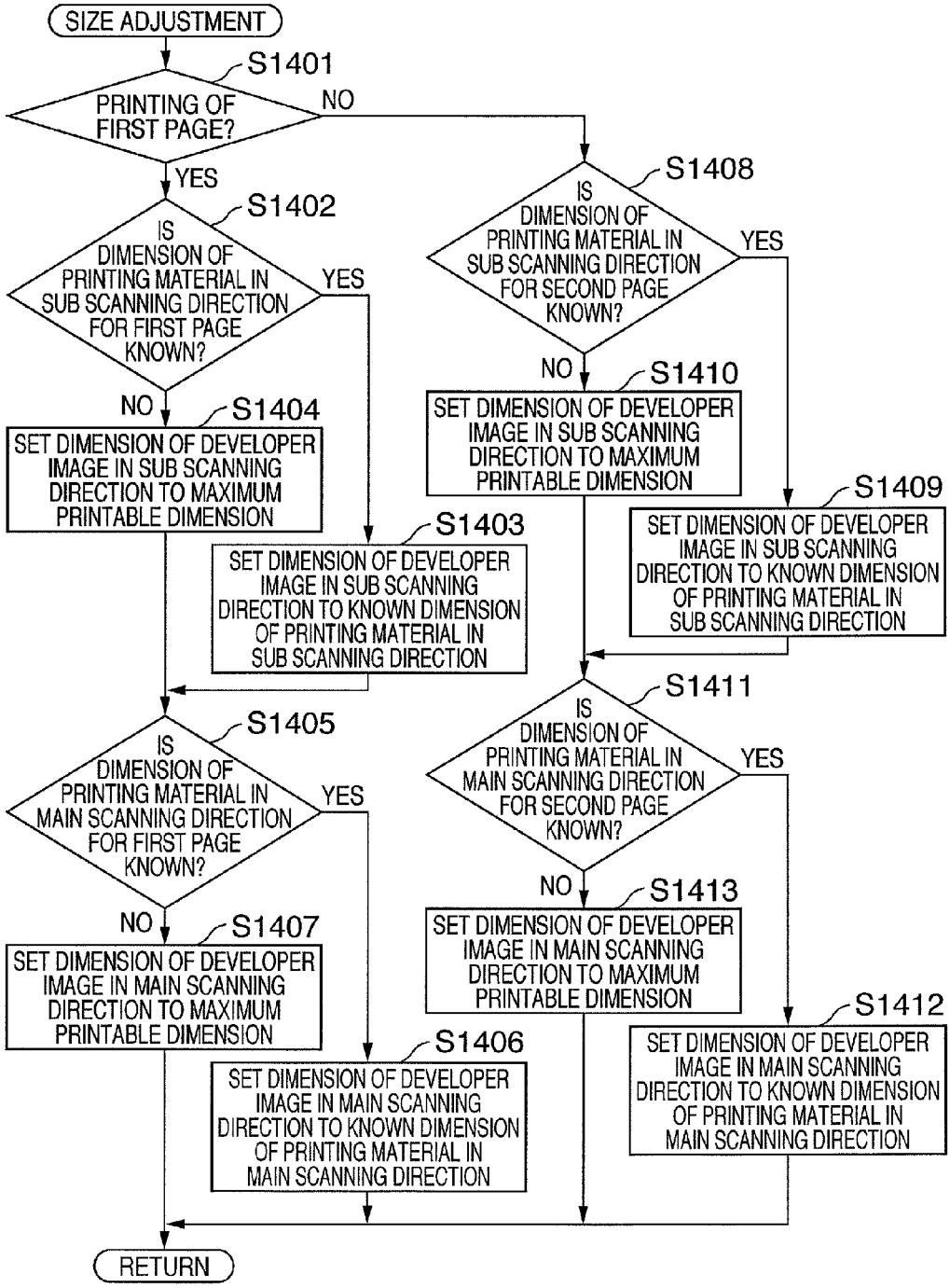
FIG. 14 is a flowchart showing control of an adjustment unit in the third embodiment.

FIG. 14 is a flowchart showing control of an adjustment unit in the third embodiment. Control of the adjustment unit 217 in this embodiment will be explained here. Processes to be descried hereinafter correspond to the detailed processes in steps S1301 and S1308 shown in FIG. 13. A description of processes which are the same as those in FIG. 8 will be omitted.

The adjustment unit 217 determines in step S1401 whether the first page of the printing material 110 is to be printed. If the first page is to be printed, the processes which are the same as those in FIG. 8 are done. That is, the processes from step S1402 to step S1407 correspond to those in step S801 to step S806, respectively. If the second page is to be printed, the adjustment unit 217 determines in step S1408 whether the dimension of the printing material 110 in the sub scanning direction for the second page is known.

If the dimension of the printing material 110 in the sub scanning direction for the second page is known, the adjustment unit 217 decides, as the dimension of the developer image in the sub scanning direction, a dimension obtained by adding a peripheral margin to the known dimension of the printing material 110 in the sub scanning direction for the second page in step S1409. If the dimension of the printing material 110 in the sub scanning direction for the second page is unknown, the adjustment unit 217 decides, as the dimension of the developer image in the sub scanning direction, a dimension obtained by adding a peripheral margin to the maximum size of a printing material printable by an image forming apparatus 100 in step S1410. As a matter of course, like the first embodiment, if the dimension of the printing material in the sub scanning direction for the first page is known, the adjustment unit 217 desirably decides, as the dimension of the developer image in the sub scanning direction, a dimension obtained by adding a peripheral margin and the dimension of the printing material in the sub scanning direction.

The adjustment unit 217 determines in step S1411 whether the dimension of the printing material 110 in the main scanning direction for the second page is known. If the dimension of the printing material 110 in the main scanning direction for the second page is known, the adjustment unit 217 decides, as the dimension of the developer image in the main scanning direction, a dimension obtained by adding a peripheral margin to the known dimension of the printing material 110 in the main scanning direction for the second page in step S1412. If the dimension of the printing material 110 in the main scanning direction for the second page is unknown, the adjustment unit 217 decides, as the dimension of the developer image in the main scanning direction, a dimension obtained by adding a peripheral margin to the maximum size of a printing material printable by the image forming apparatus 100 in step S1413. Like the dimension of the printing material in the sub scanning direction, if the dimension of the printing material in the main scanning direction is known, the adjustment unit 217 desirably decides, as the dimension of the developer image in the main scanning direction, a dimension obtained by adding a peripheral margin and the dimension of the printing material in the main scanning direction.

FIG. 15 is a table showing information stored in a memory in the third embodiment. How to store the sizes of printing materials 110 set in a paper feed cassette 111*a* and paper feed tray 111*b* in this embodiment will be explained here. A description of parts which are the same as those in FIG. 9 will be omitted.

As shown in FIG. 15, the memory 219 stores the size of the printing material 110 set for each of the paper feed cassette and paper feed tray. The memory 219 also stores the dimensions of the printing material in the main scanning direction and sub scanning direction, that are detected before image formation on the first page of the printing material 110, and the dimensions of the printing material in the main scanning direction and sub scanning direction, that are detected before image formation on the second page of the printing material 110.

As has been described above, the printing material detection unit according to this embodiment includes a first sensor which detects the dimensions of a printing material in the main scanning direction and sub scanning direction. The first sensor detects the dimensions of the printing material in the main scanning direction and sub scanning direction before the transferring unit transfers the developer image onto the first page of the printing material. The first sensor further detects the dimensions of the printing material in the main scanning direction and sub scanning direction before the transferring unit transfers the developer image onto the second page of the printing material. On the basis of the dimensions of the printing material in the main scanning direction and sub scanning direction upon printing on the first page, that are detected by the first sensor, the adjustment unit adjusts the sizes of developer images to be formed on the first pages of printing materials subsequent to the first sheet. On the basis of the dimensions of the printing material in the main scanning direction and sub scanning direction upon printing on the second page, that are detected by the first sensor, the adjustment unit further adjusts the sizes of developer images to be formed on the second pages of printing materials subsequent to the first sheet. The image forming apparatus adjusts the sizes of developer images to be formed on printing materials subsequent to the first sheet, on the basis of the sizes of the first and second pages of a printing material as the first sheet. Even when the printing material shrinks upon fixing on the first page by heat and pressure, the image forming apparatus adjusts the sizes of developer images to be formed on printing materials subsequent to the first sheet, on the basis of the size of the shrunken printing material. This makes it possible to reduce the toner consumption amount. In addition, since a plurality of sensors to detect the size of a printing material are unnecessary, the image forming apparatus can reduce the toner consumption amount while suppressing the cost.

An image forming apparatus according to the present invention which allows double-sided printing can reduce the toner consumption amount by decreasing the size of a developer image on the second page as compared with the size of a developer image printed on the first page in margin-less printing. The image forming apparatus can also preferably reduce the toner consumption amount by decreasing the size of a developer image to be formed.

The adjustment unit which adjusts the size of a developer image in each of the above-described embodiments may adopt a method of adjusting the image size by processing image data to be printed. Instead of processing image data, the adjustment unit may adjust the size of a developer image by controlling the timing of exposure by the exposure unit to adjust the exposure area in the step of causing the exposure unit to form an electrostatic latent image.

An electrophotographic image forming apparatus sometimes uses, e.g., a laser emitting unit as the exposure unit. It suffices to adjust the size of the developer image by adjusting the laser emission timing on the basis of the detected size of the printing material.

The ratio of shrinkage after fixing may change depending on the type of printing material. The adjustment unit may correct the adjustment amount of the size of image data on the basis of parameters associated with the thickness of a printing material as an example of the type of printing material. More specifically, a thick printing material may exhibit a low ratio of shrinkage after fixing, and a thin printing material may exhibit a higher ratio of shrinkage after fixing than that of the thick printing material. Hence, it is effective to correct the size of image data on the basis of parameters associated with the thickness.

Parameters associated with the thickness of a printing material may be set in accordance with the type of printing material designated by the user, or may be detected using a sensor 126 which detects the type of printing material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-051168, filed Feb. 27, 2006 and No. 2007-034040, filed Feb. 14, 2007, which are hereby incorporated by reference herein in their entirety.

What is claimed is:

1. An image forming apparatus that forms an image on both surfaces of a printing material without a margin by forming an image of a size that is larger than the printing material, the image forming apparatus comprising:

an image forming unit adapted to form an image to be larger than a printing material so as to form the image on the printing material without a margin;

an image bearing member adapted to bear the image formed by said image forming unit;

a transferring unit adapted to transfer the image formed on said image bearing member onto the printing material;

a fixing unit adapted to fix the image transferred by said transferring unit to the printing material;

a double-sided conveying unit adapted to turn over the printing material output from said fixing unit and return the printing material to said transferring unit;

a printing material type determination unit to determine a type of printing material by (i) a user designation or (ii) a sensor for detecting the type of printing material;

a first detection unit adapted to detect a first size of the printing material in a convey direction before transferring the image onto a first page of the printing material;

a second detection unit adapted to detect a second size of the printing material in a direction that is orthogonal to the convey direction before transferring the image onto the first page of the printing material; and a setting unit adapted to set a size of the image, wherein (i) in a case where the first size of the printing material is unknown, said setting unit sets a size of a first image corresponding to a first page of the printing material in the convey direction to a size corresponding to a predetermined maximum size of the printing material, and (ii) in a case where the second size of the printing material is unknown, said setting unit sets the size of the first image corresponding to the first page of the printing material in the direction that is orthogonal to the convey direction to the size corresponding to the predetermined maximum size of the printing material, and wherein said setting unit sets a size of a second image corresponding to a second page of the printing material to a small size that is smaller than the size of the first image, the size of the second image being set based on the first size detected by said first detection unit, the second size detected by said second detection unit, an adjustment amount for a change of a size of the printing material due to fixing of the first image to the first page of the printing material, and a correction of the adjustment amount due to the type of the printing material determined by said printing material type determination unit.

2. The image forming apparatus according to claim 1, further comprising:

a paper feed unit which includes a plurality of paper feed cassettes; and a storage unit adapted to store the detected first size and the detected second size of the printing material for each of said plurality of paper feed cassettes, wherein said setting unit sets a size of an image to be formed on a printing material fed from a specific paper feed cassette of said plurality of paper feed cassettes, on the basis of a size of a printing material of the same type having been previously fed from said specific paper feed cassette, which is stored in said storage unit.

3. The image forming apparatus according to claim 2, wherein said paper feed unit further includes:

a sensing unit adapted to sense whether any one of said paper feed cassettes is detached, wherein when said sensing unit senses that any one of said paper feed cassettes is detached, said detached paper feed cassette causes said sensing unit to delete size information of a printing material in said detached paper feed cassette from said storage unit.

4. The image forming apparatus according to claim 1, wherein said second detection unit includes:

two main scanning direction sensors juxtaposed in a main scanning direction, which is orthogonal to the convey direction of the printing material; and wherein said first detection unit includes:

a flag sensor which is disposed on a convey path and includes a member that operates in the convey direction of the printing material.

5. The image forming apparatus according to claim 1, wherein said transferring unit executes registration processing for matching positions of the image and the printing material at a timing when said first detection unit detects a leading edge of the printing material.

6. The image forming apparatus according to claim 1, wherein said image forming unit includes:

an image carrier and an exposure unit which forms a latent image on said image carrier, wherein said setting unit sets the size of the image by controlling said exposure unit to adjust a size of the latent image to be formed on said image carrier.

7. The image forming apparatus according to claim 1, wherein said setting unit sets a size of the image on the first page of a printing material next to be supplied in accordance with the detected first size and the detected second size of the printing material.

8. The image forming apparatus according to claim 1, wherein the size of the second imagine when the printing material is a thick paper type is larger than the size of the second image when the printing material is a thin paper type.

9. A control method for an image forming apparatus that forms an image on both surfaces of a printing material without a margin by forming an image of a size that is larger than the printing material, the control method comprising the steps of:

feeding the printing material from a feeding portion;

transferring the image onto the printing material using a transferring unit;

fixing the image transferred in the transferring step to the printing material;

turning over the printing material to which the image is fixed and returning the printing material to the transferring unit;

determining a type of printing material by (i) a user designation or (ii) a sensor for detecting the type of printing material;

detecting a first size of the printing material in a convey direction before transferring the image onto a first page of the printing material;

detecting a second size of the printing material in a direction that is orthogonal to the convey direction before transferring the image onto the first page of the printing material;

setting, in a case where the first size of the printing material is unknown, a size of a first image corresponding to the first page of the printing material in the convey direction to a size corresponding to a predetermined maximum size of the printing material;

setting, in a case where the second size of the printing material is unknown, the size of the first image corresponding to the first page of the printing material in a direction that is orthogonal to the convey direction to the size corresponding to the predetermined maximum size of the printing material; and setting a size of a second image corresponding to a second page of the printing material to a small size that is smaller than the size of the first image, the size of the second image being set based on the detected first size, the detected second size, an adjustment amount for a change of a size of the printing material due to fixing of the first image to the first page of the printing material, and a correction of the adjustment amount due to the type of the printing material determined by the determining step.

10. The control method according to claim 9, wherein the size of the second image in a case when the printing material is a thick paper type is larger than the size of the second image when the printing material is a thin paper type.

* * * * *